US005213588A

United States Patent [19]

Wong et al.

[11] Patent Number: 5,213,588

[45] Date of Patent: May 25, 1993

[54] ABRASIVE WIPING ARTICLES AND A PROCESS FOR PREPARING SUCH ARTICLES

[75] Inventors: Arthur Wong, West Chester; Larry N. Mackey, Fairfield; James J. Franxman, Cincinnati; John B. Burchnall, West Chester, all of Ohio

[73] Assignee: The Procter & Gamble Company, Cincinnati, Ohio

[21] Appl. No.: 868,386

[22] Filed: Apr. 14, 1992

Related U.S. Application Data

[63] Continuation-in-part of Ser. No. 830,811, Feb. 4, 1992, abandoned.

[51] Int. Cl.[5] ..... B24D 17/00

[52] U.S. Cl. ..... 51/293; 51/295; 51/298; 525/221

[58] Field of Search ..... 51/293, 295, 298; 525/221, 227, 228, 194; 15/209 B, 104.93

[56] References Cited

U.S. PATENT DOCUMENTS 2,665,528 1/1954 Sternfield et al. ..... 15/104.93
2,926,116 2/1960 Keim ..... 162/164

(List continued on next page.)

FOREIGN PATENT DOCUMENTS 1191727 8/1985 Canada .
0211664 2/1987 European Pat. Off. .
1445295 8/1976 United Kingdom .

OTHER PUBLICATIONS

"Some Reactions of Epichlorohydrin with Amines," Joseph H. Ross et al., Paper Chemicals Research Dept., American Cyanamid Co. Stamford, CT. Apr. 1964.
"The Chemistry of a Polyamide-Epichlorohydrin Resin (Hercosett 125) Used to Shrink-resist Wool", G. B. Guise & G. C. Smith, CSIRO Divisin of Textile Industry, Belmont, Geelong, Victoria 3216, Australia 1985.

*Primary Examiner*—Mark L. Bell
*Assistant Examiner*—Deborah Jones
*Attorney, Agent, or Firm*—E. Kelly Linman; Eric W. Guttag

[57] ABSTRACT

Disclosed are abrasive wiping articles, e.g., nonwoven, preferably paper towels, which comprise an absorbant nonwoven substrate having printed thereon a cured scrubbing bead mixture which comprises a) certain carboxylated, ionically-charged polymeric abrasive particles, b) a carboxyl group-containing polymeric adhesive material, and c) an amino-epichlorohydrin, e.g., Kymene®, cross-linking agent. The polymeric abrasive particles range in size from about 20 to 400 microns and have a Knoop hardness of from about 4 to 25. The polymeric adhesive material, upon curing, has a Knoop hardness of from about 0.5 to 17.

Preferred wiping articles of the foregoing type have a pattern of the scrubbing bead mixture printed onto from about 20% to 70% of the surface area of a paper substrate with the abrasive particles affixed to the substrate in such a manner that their exposed portion extends for a distance of from about 40 to 300 microns above the surface of the paper substrate. Wiping articles of this type are especially useful for removing soil and stain from hard surfaces with the polymeric scrubbing particles thereon being especially resistant to removal during use.

Also disclosed is a process for preparing abrasive wiping articles as hereinbefore described. Such a process involves printing a pattern of the scrubbing bead mixture onto the paper substrate, drying the printed substrate and then curing the solid components of the scrubbing bead mixture to affix the abrasive scrubbing particles to the substrate. Curing of the particular scrubbing bead mixture employed can take place at room temperature.

27 Claims, 7 Drawing Sheets

U.S. PATENT DOCUMENTS

| | | | |
|---|---|---|---|
| 2,926,154 | 2/1960 | Keim | 260/29.2 |
| 3,080,688 | 3/1963 | Politzer | 51/295 |
| 3,116,574 | 1/1964 | Clesielski | 15/104.93 |
| 3,121,249 | 2/1964 | Affleck et al. | 15/104.93 |
| 3,175,331 | 3/1965 | Klein | 251/295 |
| 3,301,746 | 1/1967 | Sanford et al. | 162/113 |
| 3,332,901 | 7/1967 | Keim | 260/29.2 |
| 3,382,058 | 5/1968 | Wise et al. | 51/295 |
| 3,414,459 | 12/1968 | Wells | 161/131 |
| 3,642,502 | 2/1972 | Scheider | 106/23 |
| 3,711,884 | 1/1973 | Feig | 15/104.93 |
| 3,905,863 | 9/1975 | Ayers | 162/113 |
| 3,974,025 | 8/1976 | Ayers | 162/113 |
| 3,994,771 | 11/1976 | Morgan, Jr. et al. | 162/113 |
| 4,078,340 | 3/1978 | Klecker et al. | 51/295 |
| 4,142,334 | 3/1979 | Kirsch et al. | 51/395 |
| 4,189,395 | 2/1980 | Blund | 51/295 |
| 4,191,609 | 3/1980 | Trokhan | 162/113 |
| 4,264,337 | 4/1981 | Fenster et al. | 51/295 |
| 4,310,593 | 1/1982 | Gross | 428/290 |
| 4,440,597 | 4/1984 | Wells et al. | 162/113 |
| 4,469,735 | 9/1984 | Trokham | 428/154 |
| 4,529,480 | 7/1985 | Trokhan | 162/117 |
| 4,637,859 | 1/1987 | Trokhan | 162/113 |
| 5,073,235 | 12/1991 | Trokhan | 162/199 |

ABRASIVE WIPING ARTICLES AND A PROCESS FOR PREPARING SUCH ARTICLES

CROSS-REFERENCE TO RELATED APPLICATION

This application is a continuation-in-part of the copending application having U.S. application Ser. No. 07/830,811, filed Feb. 4, 1992, now abandoned, in the names of Arthur Wong, Larry N. Mackey, James J. Franxman and John B. Burchnall.

FIELD OF THE INVENTION

The present invention relates to the preparation of nonwoven, preferably non-durable, e.g., paper, wiping articles which are useful for cleaning up both solid and liquid spills and soil from hard surfaces in connection with household cleaning operations. Such wiping articles have a mildly abrasive character imparted to at least one surface thereof by affixing thereto a certain type and amount of polymeric scrubbing bead particles.

BACKGROUND OF THE INVENTION

Nonwoven webs or sheets such as those made of paper find extensive use in modern society in the context of household cleaning activity. Paper towels, for example, are a staple item of commerce which have long been used to wipe up liquid spills and to remove stains and/or soil from hard surfaces such as window glass, countertops, sinks, porcelain and metal fixtures, walls and the like, and from other surfaces such as carpeting or furniture.

Paper towels products which are especially useful for household cleaning have attributes which include relatively low density, high bulk, acceptable softness, high absorbency for both aqueous and nonaqueous liquids and acceptable strength and integrity, especially when wet. Prior art towel products having such attributes, and processes for their preparation, have been disclosed, for example, in Ayers, U.S. Pat. No. 3,905,863, Issued Sep. 16, 1975; Ayers, U.S. Pat. No. 3,974,025, Issued Aug. 10, 1976; Trokhan, U.S. Pat. No. 4,191,609, Issued Mar. 4, 1980; Wells and Hensler, U.S. Pat. No. 4,440,597, Issued Apr. 3, 1984; Trokhan, U.S. Pat. No. 4,529,840, Issued Jul. 16, 1985; and Trokhan, U.S. Pat. No. 4,637,859, Issued Jan. 20, 1987.

Paper towels, such as those of the types described in the foregoing patents, are especially useful for absorbing and wiping up liquid spills from both hard surfaces and other surfaces such as furniture and carpets. Paper towel products, however, are also frequently used, generally in combination with liquid cleaning solutions or solvents, to remove soil or stains from surfaces to which such soil or stains may be especially securely affixed. Such soil or stains, for example, may include food material which has been baked on to stove, oven, or cooking utensil surfaces, soap scum found in bathtubs and sinks, ink or crayon markings on walls and furniture, and the like. For wiping products especially useful for such soil and stain removal, it is generally desirable to impart at least some degree of abrasivity to the wiping article in order to bring about the loosening and subsequent removal of the soil or stain from the surface to be cleaned.

Hard surface wiping products which contain abrasive material to enhance soil and stain removal performance are known in the art. For example, Wise et al; U.S. Pat. No. 3,382,058; Issued May 7, 1968 describes a disposable scouring pad having an adhesive abrasive composition adhered to a flexible porous base such as paper. Furthermore, Peter et al; European Patent Application, EP-A-211,664, Published Feb. 25, 1987 discloses a layered sheet-like article having at least one surface containing particles of a soft polymeric abrasive material.

Fabrication of abrasive wiping articles, such as those of the types known in the art, is not without its difficulties. The abrasive material which is associated with such articles must be selected so as to be effective at promoting soil loosening and removal but must not be damaging to the surfaces to be cleaned with the article. The abrasive material must furthermore be affixed to the base substrate using means and in a manner which does not adversely affect the softness and absorbency properties of the wiping article but which nevertheless provides acceptably secure attachment of the abrasive material to the substrate. For example, there should be no significant removal or detachment of abrasive particles from the base substrate as the article is being used, even when wiping occurs in the presence of bleach-free cleaning solutions or solvents.

Given the foregoing, there is a continuing need to identify commercially practical, suitably strong cleaning and wiping products which provide superior absorbency for liquids with enhanced ability to remove soil and stains from surfaces to be cleaned therewith. Accordingly, it is an object of the present invention to provide nonwoven, preferably paper-based, abrasive wiping articles which have acceptable wet strength, desirably high absorbent capacity for liquids and especially effective soil and stain removal performance.

It is a further object of the present invention to provide such abrasive wiping articles having abrasive material affixed thereto in a manner which provides acceptable resistance to abrasive material removal during contact with bleach-free cleaning solutions or solvents which may be encountered when the article is used in household cleaning operations.

It is a further object of the present invention to provide such abrasive wiping articles which can be prepared using cost effective means for affixing abrasive material to the base paper substrate from which such articles are formed.

SUMMARY OF THE INVENTION

In its article aspects, the present invention relates to an abrasive, preferably non-durable paper, wiping article suitable for cleaning hard surfaces. Articles of this type are fashioned from an absorbent nonwoven substrate having a basis weight of from about 30 to 100 $g/m^2$. An abrasively effective amount of a scrubbing bead mixture is printed in a pattern onto at least one surface of the base nonwoven substrate and is then cured. Prior to curing, the scrubbing bead mixture has a viscosity of from 70 to 2500 centipoise and a surface tension value of from about 24 to 32 dynes/cm. Furthermore, the scrubbing bead mixture comprises from about 30% to 70% by weight of the total solids therein of carboxylated, ionically charged polymeric abrasive particles, from about 30% to 70% by weight of the total solids therein of a carboxyl group-containing polymeric adhesive material and from about 1% to 10% by weight of the polymeric adhesive of an amino-epichlorohydrin cross-linking agent.

The polymeric abrasive particles used in the scrubbing bead mixture range in particle size from about 20 to 400 microns and have a Knoop hardness of from about 4 to 25. The polymeric adhesive material used in the scrubbing bead mixture, upon curing, has a Knoop hardness of from about 0.5 to 17. The amino-epichlorohydrin cross-linking agent component of the scrubbing bead mixture comprises the reaction product of epichlorohydrin and an amine which can either be a monomeric mono-, di- or triamine or a polyamide-polyamine derived from a polyalkylene polyamine and a $C_3$–$C_{10}$ dibasic carboxylic acid.

In a preferred embodiment of the abrasive wiping articles herein, the abrasive particles range in particle size from about 100 to 300 microns and have a Knoop hardness of from about 15 to 22. A substantial portion of the particles used in such a preferred embodiment have a plurality of angular cutting edges on their particle surfaces. Such particles are affixed to the nonwoven substrate in a manner such that the average dimension of the exposed portion of the abrasive particles which extends perpendicularly from the nonwoven substrate surface ranges from about 40 to 300 microns.

In its process-for-article-preparation aspects, the present invention comprises printing onto at least one surface of an absorbent nonwoven substrate of the type hereinbefore described an abrasively effective amount of a scrubbing bead mixture also of the type hereinbefore described. The substrate so printed is then dried to achieve a consistency of at least about 90% in the wiping article. The dried substrate is then further subjected to curing conditions of time and temperature which are sufficient to promote formation of covalent cross-linking bonds between and within the chemically reactive components of the scrubbing bead mixture.

DETAILED DESCRIPTION OF THE INVENTION

Figure 1:
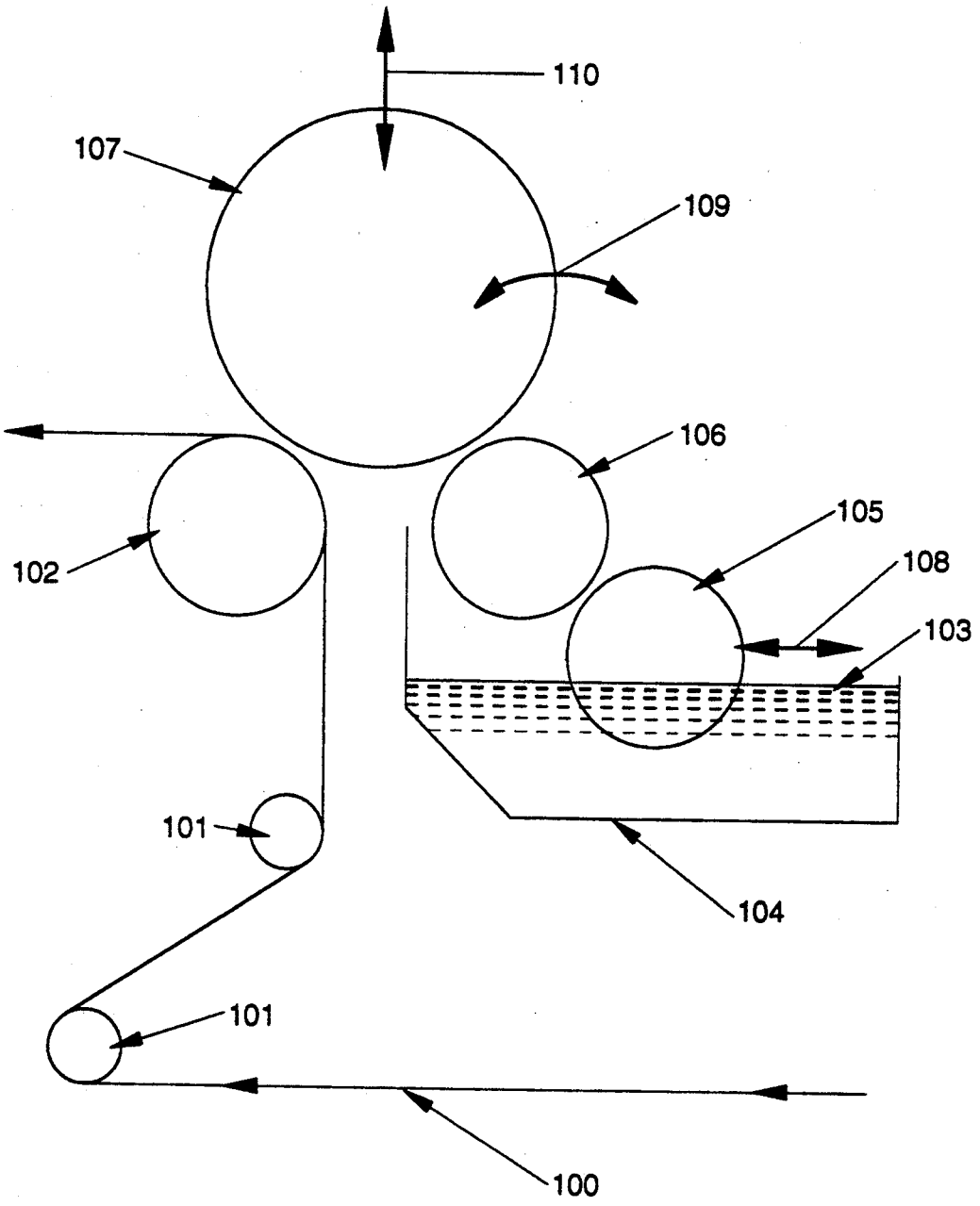
FIG. 1 is a schematic diagram of a flexographic printing process which can be employed to prepare the abrasive wiping articles of the present invention.

The abrasive wiping articles of the present invention comprise an absorbent nonwoven substrate having printed thereon and affixed thereto a pattern of solid polymeric particles which serve as abrasive scrubbing beads. The base nonwoven substrate, the liquid dispersion of the scrubbing beads which is printed onto the substrate and then cured, and the process for preparing the wiping article from the substrate and scrubbing bead mixture are all described in detail as follows:

A) Base Nonwoven Substrate

The base nonwoven substrate used to form the abrasive wiping articles herein can comprise any conventionally fashioned nonwoven sheet or web having suitable basis weight, caliper, absorbency and strength characteristics. Nonwoven substrates can be generally defined as bonded fibrous or filamentous products having a web structure, in which the fibers or filaments can be distributed haphazardly as in "air-laying" or certain "wet-laying" processes, or with a degree of orientation, as in certain "wet-laying" or "carding" processes. The fibers or filaments of such nonwoven substrates can be natural (e.g., wood pulp, wool, silk, jute, hemp, cotton, linen, sisal or ramie) or synthetic (e.g., rayon, cellulose ester, polyvinyl derivatives, polyolefins, polyamides or polyesters) and can be bonded together with a polymeric binder resin. Examples of suitable commercially available nonwoven substrates include those marketed under the tradename Sontara® by DuPont and Polyweb® by James River Corp.

For reasons of cost, ease of manufacture and article disposability, the preferred type of nonwoven substrate used for the wiping articles herein comprises those made from wood pulp fibers, i.e. paper substrates. As noted, paper substrates can be prepared by either air-laying or wet-laying techniques. Air-laid paper substrates such as Air Tex® SC130 are commercially available from James River Corp.

More conventionally, paper substrates are produced via wet-laying procedures. In such procedures, a substrate is made by forming an aqueous papermaking furnish, depositing this furnish onto a foraminous surface, such as a Fourdrinier wire, and by then removing water from the furnish, for example by gravity, by vacuum assisted drying and/or by evaporation, with or without pressing, to thereby form a paper web of desired fiber consistency. In many cases, the papermaking apparatus is set up to rearrange the fibers in the slurry of papermaking furnish as dewatering proceeds in order to form paper substrates of especially desirable strength, hand, bulk, appearance, absorbency, etc.

The papermaking furnish utilized to form the preferred base paper substrate for the articles herein essentially comprises an aqueous slurry of papermaking fibers (i.e., paper pulp) and can optionally contain a wide variety of chemicals such as wet strength resins, surfactants, pH control agents, softness additives, debonding agents and the like. Wood pulp in all its variations can be used to form the papermaking furnish. Wood pulps useful herein include both sulfite and sulfate pulps, as well as mechanical, thermo-mechanical and chemo-thermo-mechanical pulps, all of which are well known to those skilled in the papermaking art. Pulps derived from both deciduous or coniferous trees can be used. Preferably the papermaking furnish used to form the preferred base paper substrate for the articles herein comprises Kraft pulp derived from northern softwoods.

A number of papermaking processes have been developed which utilize papermaking apparatus that forms paper webs having particularly useful or desirable fiber configurations. Such configurations may serve to impart such characteristics of the paper substrate as enhanced bulk, absorbency and strength. One such process employs an imprinting fabric in the papermaking process, which fabric serves to impart a knuckle pattern of high density and low density zones into the resulting paper web. A process of this type, and the papermaking apparatus for carrying out this process, is described in greater detail in Sanford and Sisson; U.S. Pat. No. 3,301,746; Issued Jan. 31, 1967, which patent is incorporated herein by reference.

Another papermaking process, carried out with special papermaking apparatus, is one which provides a paper substrate having a distinct, continuous network region formed by a plurality of "domes" dispersed throughout the network region on the substrate. Such domes are formed by compressing an embryonic web as formed during the papermaking process into a foraminous deflection member having a patterned network surface formed by a plurality of discrete isolated deflection conduits in the deflection member surface. A process of this type, and apparatus for carrying out such a process, is described in greater detail in Trokhan; U.S. Pat. No. 4,529,480; Issued Jul. 16, 1985; Trokhan; U.S. Pat. No. 4,637,859; Issued Jan. 20, 1987 and Trokhan; U.S. Pat. No. 5,073,235; Issued Dec. 17, 1991. All of these patents are incorporated herein by reference.

Still another papermaking process, and apparatus to carry it out, suitable for use in making a layered composite paper substrate which can serve as a base paper substrate for the articles of the present invention is described in Morgan and Rich; U.S. Pat. No. 3,994,771; Issued Nov. 30, 1976. This patent is also incorporated herein by reference.

No matter what type of nonwoven webs are used and no matter what type of process and apparatus are used to prepare the base substrate for the abrasive wiping articles herein, the resulting base substrate should be of sufficient basis weight, caliper, strength and absorbency to be useful as a wiping article for cleaning hard surfaces in household cleaning applications. Generally, the base substrate will have a single ply basis weight ranging from about 15 to 50 g/m$^2$ (~10 to ~30 lbs/3,000 ft$^2$), more preferably from about 20 to 40 g/m$^2$ (~12 to ~25 lbs/3,000 ft$^2$), most preferably from about 25 to 35 g/m$^2$ (~15 to ~22 lbs/3,000 ft$^2$). Frequently the single ply dry caliper of the base substrate onto which the scrubbing bead mixture is eventually printed will range (at 0.2 psi confining pressure) from about 0.25 to 0.76 mm (10 to 30 mils), more preferably from about 0.37 to 0.65 mm (15 to 25 mils). Frequently also the base nonwoven substrate will exhibit an absorbency of from about 10 to 40 ml of water per gram of dry substrate when the substrate is subjected to the Horizontal Absorptive Capacity Test as set forth in Trokhan; U.S. Pat. No. 4,469,735; Issued Sep. 4, 1984. This patent is incorporated herein by reference.

The preferred base paper substrate as hereinbefore described may form one of two or more plies which can be laminated together to form the ultimately utilized wiping article. Lamination, and lamination carried out in combination with an embossing procedure to form a plurality of protuberances in the laminated product, is described in greater detail in Wells; U.S. Pat. No. 3,414,459; Issued Dec. 3, 1968, which patent is incorporated herein by reference. As described in greater detail hereinafter, the scrubbing bead mixture used in the preparation of the articles herein may be printed onto a preferred base paper substrate either before or after paper substrate plies have been laminated together to form a final laminated paper towel product.

B) Scrubbing Bead Mixture

1) Abrasive Scrubbing Beads

The abrasive wiping articles herein are formed by printing onto the base nonwoven substrate as hereinbefore described, and by then subsequently curing, a liquid, e.g., aqueous, dispersion containing solid polymeric abrasive particles. Such particles, when affixed to the base nonwoven substrate by means of the cured adhesive components of the scrubbing bead mixture, impart desirable enhanced soil removal performance characteristics to the wiping articles of the present invention.

The physical characteristics of the scrubbing bead particles, are, of course, important in imparting the requisite abrasivity to the abrasive wiping products herein. The principal physical characteristics of the scrubbing beads themselves which influence abrasivity are particle shape, particle size and particle hardness.

Frequently the polymeric scrubbing bead particles will be utilized in the form of generally spherical particles. Commercial polymerization methods used to manufacture polymer materials that are suitable for the abrasive particles herein will provide the polymerized material in the form of generally spherical beads. Spherical beads of useful polymeric materials are thus readily commercially available.

While generally spherical beads can be suitably employed in the abrasive wiping articles herein, it is preferred that the particles used be prepared or processed to impart a plurality of angular cutting edges on the surfaces of at least a substantial fraction of the abrasive particles which are affixed to the base substrate. This can be accomplished by grinding or milling generally spherical particles to fracture the particles into smaller particles having the desired angular cutting edges. Alternatively, synthetic polymeric material can be prepared, e.g., by melting and resolidifying spherical particles, into block or sheet form, and such sheets or blocks can then be fractured, ground, milled or otherwise finely divided or comminuted into scrubbing bead particles of the desired angularity and size.

Abrasive particle size is also important in imparting suitable hard surface cleaning capability to the abrasive wiping articles herein. For effective cleaning performance, the abrasive particles affixed to the surface of the base nonwoven substrate should range in particle size from about 20 to 400 microns, more preferably from about 100 to 300 microns. For purposes of the present invention, particle size for generally spherical particles refers, of course, to particle diameter. For irregularly shaped, non-spherical particles, particle size refers to the minor diameter of such abrasive particle. Realization of either spherical or irregularly shaped particles of acceptable size can be provided by conventional sieving or screening operations. The abrasive particles useful herein are those which pass through a 35 mesh (Tyler) screen but are retained on a 500 mesh (Tyler) screen. More preferably, the particles useful herein are those which pass through a 48 mesh (Tyler) screen but are retained on a 150 mesh (Tyler) screen.

Particle hardness is also important in realizing suitable soil removal performance with acceptable safety to hard surfaces to be cleaned by the wiping articles herein. The scrubbing bead particles of this invention will thus have a Knoop hardness which ranges from about 4 to 25, more preferably from about 15 to 22. Particles of suitable hardness can be realized by forming the particles from appropriate types of polymeric material.

In addition to the physical characteristics of particle shape, size and hardness, the polymeric scrubbing bead particles herein must also have certain additional chemical characteristics beyond those needed to provide the requisite particle hardness. More specifically, the scrubbing bead particles herein must comprise a polymeric material which has carboxylic functional groups on the polymer backbone. The carboxylic functional groups on the polymer backbone serve to form covalent cross-linking bonds between the abrasive particle polymer and the polymer chains of the adhesive and the reactive groups of the amino-epichlorohydrin cross-linking agent also essentially utilized in the scrubbing bead mixture as hereinafter more fully described.

The pendant carboxyl groups on the polymer backbone of the scrubbing bead material also serve to impart an ionic charge to the scrubbing beads. This ionic charge promotes desirable suspension of the scrubbing beads in the aqueous scrubbing bead mixture which in turn enhances the printability of the scrubbing bead mixture onto the base nonwoven substrate. The polymer which is used to form scrubbing beads that are useful herein will thus generally contain carboxyl groups to the extent that, in unneutralized form, the polymer material exhibits an Acid Number which ranges from about 3 to 50, more preferably from about 8 to 37. Acid Number for purposes of this invention is defined as the number of milligrams of KOH per gram of polymer needed to neutralize the carboxylic acid groups on the polymer.

Within the foregoing constraints, a wide variety of polymers and copolymers may be used to form the polymeric scrubbing beads. Suitable polymer/-copolymer types for use as the material of the scrubbing beads include carboxylated polyacrylic resins such as polymethyl methacrylate and polymethyl methacrylate copolymers; polycarbonate resins; polyacrylonitrile resins; polystyrene resins; styrene, butadiene and/or acrylonitrile copolymers; and polyvinyl chloride resins. These and other types of polymeric materials which can be used for the scrubbing beads herein, when carboxylated, are described in Wise et al; U.S. Pat. No. 3,382,058; Issued May 7, 1968, incorporated herein by reference. Two especially suitable types of polymeric scrubbing beads are the carboxylated polymethyl methacrylate materials marketed by Du Pont under the tradename Elvacite® and the carboxylated styrene-butadiene materials marketed by Reichhold Chemicals, Inc. under the tradename Tyrez®.

The polymeric scrubbing beads will generally comprise from about 30% to 70% by weight of the total solids in the scrubbing bead mixture. More preferably, the scrubbing beads will comprise from about 40% to 60% by weight of the total solids in this mixture. For purposes of this invention, "total solids" refers to the amount of polymeric and other material which would remain if the solvent, e.g. water, were completely evaporated from the scrubbing bead mixture.

2) Polymeric Adhesive

A second essential component of the scrubbing bead mixture used to prepare the abrasive wiping articles herein is a polymeric adhesive material. The adhesive serves to affix the abrasive scrubbing beads to the base nonwoven substrate. The adhesive also imparts enhanced tensile and burst strength to the base nonwoven substrate and, in particular, is useful for improving the wet strength properties of the wiping articles herein.

The most important features of the polymeric adhesive component of the scrubbing bead mixture are its hardness and flexibility properties upon curing. Features of this type can be quantified by specifying a Knoop hardness value for the cured adhesives or blends of adhesives which make up this component. Thus, any polymeric adhesive material, or blend of such materials, can be employed in the scrubbing bead mixture so long as the adhesive provides, upon curing, a Knoop hardness of from about 0.5 to 17, more preferably from about 0.5 to 12. In some instances it may be desirable to use polymeric adhesive materials which, upon curing, are relatively hard. Such relatively harder adhesives can, in turn, be employed in scrubbing bead mixtures of relatively lower viscosities as hereinafter described. In these instances, the polymeric adhesive material, or blends of such materials, should be those which cure to a Knoop hardness of from about 8 to 15, more preferably from about 10 to 14.

The specific chemical nature of the polymeric adhesive is not critical so long as the cured adhesive has the requisite physical characteristics as hereinbefore described. However, to facilitate during curing the appropriate chemical interactions with the other components of the scrubbing bead mixture such as the scrubbing beads themselves and the amino-epichlorohydrin cross-linking agent, the polymeric adhesive used herein will generally also have reactive carboxyl groups on its polymeric backbone.

Preferred adhesive materials which provide the requisite physical properties and the requisite cross-linking reactivity will frequently be those used in the form of latex materials. Preferred types of latexes are those anionic latexes formed from acrylic acid-based emulsion polymers and copolymers. Especially preferred acrylic acid-based latexes are those marketed by Rohm & Haas under the tradename Rhoplex®. Rhoplex® E-1847, Rhoplex® TR-520 and Rhoplex® B-85 are examples of commercially available latexes which can provide both the requisite chemical and physical characteristics for use in the present invention. Blends of latex materials such as these may also be usefully employed in the scrubbing bead mixtures herein to achieve the desired balance of physical properties, e.g., hardness, upon curing and chemical reactivity to promote curing.

The polymeric adhesive component will generally comprise from about 30% to 70% by weight of the total solids in the scrubbing bead mixture to be printed onto the base nonwoven paper substrate. Preferably the polymeric adhesive will comprise from about 40% to 60% by weight of the total solids of the scrubbing bead mixture.

3) Amino-Eoichlorohydrin Cross-Linking Agent

A third essential component of the scrubbing bead mixture herein comprises a particular type of cross-linking agent which is an adduct of epichlorohydrin and certain types of monomeric or polymeric amines. While not being bound by theory, it is believed that reactive groups, such as azetidinium moieties, in the structure of such amino-epichlorohydrin adducts can form covalent cross-linking bonds not only within the amino-epichlorohydrin adduct itself but also with the carboxylic functionalities of both the abrasive scrubbing beads and the polymeric adhesive material. This, in turn, is believed to promote especially tenacious adherence of the polymeric scrubbing bead particles to the base paper substrate. Such adherence manifests itself in improved resistance of the scrubbing beads to removal by solvents such as isopropanol or surfactant solutions which may be encountered during hard surface cleaning operations using the abrasive wiping articles of this invention. Furthermore, the amino-epichlorohydrin cross-linking agent, with its ability to promote enhanced formation of covalent cross-linking bonds, may be responsible for the ability to cure the printed scrubbing bead mixture on the base nonwoven substrate at relatively low temperatures, e.g., at room temperature.

One type of amino compound which can be reacted with epichlorohydrin to form cross-linking agents which are useful herein comprises monomeric mono-, di- and triamines having primary or secondary amino groups in their structures. Examples of useful monoamines of this type include ammonia, ethyl amine, methyl amine, and propyl amine. Examples of useful diamines of this type include bis-2-aminoethyl ether, N,N-dimethyl ethylene diamine, piperazine, and ethylenediamine. Examples of useful triamines of this type include N-aminoethyl piperazine, and dialkylene triamines such as diethylene triamine, and dipropylene triamine.

Such amine materials are reacted with epichlorohydrin to form the amino-epichlorohydrin adducts which can serve as the cross-linking agents herein. Preparation of these adducts as well as a more complete description of the materials themselves are found in Gross; U.S. Pat. No. 4,310,593; Issued Jan. 12, 1982 and in Ross et al; *J. Organic Chemistry,* Vol. 29 pp 824–826 (1964). Both of these publications are incorporated herein by reference.

Another type of amino compound which can be reacted with epichlorohydrin to form cross-linking agents which are useful herein comprises certain polyamide-polyamines derived from polyalkylene polyamines and saturated $C_3$–$C_{10}$ dibasic carboxylic acids. Epichlorohydrin/polyamide-polyamine adducts of this kind are water-soluble, thermosetting cationic polymers which are well known in the art as wet strength resins for paper products.

In the preparation of polyamide-polyamines used to form this class of cross-linking agents, a dicarboxylic acid is first reacted with a polyalkylene-polyamine, preferably in aqueous solution, under conditions such as to produce a water-soluble, long chain polyamide containing the recurring groups $—NH(C_nH_{2n}HN)_x—CORCO—$ where n and x are each 2 or more and R is the $C_1$ to $C_8$ alkylene group of the dicarboxylic acid.

A variety of polyalkylene polyamines including polyethylene polyamines, polypropylene polyamines, polybutylene polyamines and so on may be employed to prepare the polyamide-polyamine, of which the polyethylene polyamines represent an economically preferred class. More specifically, preferred polyalkylene polyamines used to prepare the cross-linking agents herein are polyamines containing two primary amine groups and at least one secondary amine group in which the nitrogen atoms are linked together by groups of the formula $—C_nH_{2n}—$ where n is a small integer greater than unity and the number of such groups in the molecule ranges from two up to about eight and preferably up to about four. The nitrogen atoms may be attached to adjacent carbon atoms in the group $—C_nH_2n—$ or to carbon atoms further apart, but not to the same carbon atom. Also contemplated is the use of such polyamines as diethylenetriamine, triethylenetetramine, tetraethylenepentamine, dipropylenetriamine, and the like, which can be obtained in reasonably pure form. Of all the foregoing, the most preferred are the polyethylene polyamines containing from two to four ethylene groups, two primary amine groups, and from one to three secondary amine groups.

Also contemplated for use herein are polyamine precursor materials containing at least three amino groups with at least one of these groups being a teriary amino group. Suitable polyamines of this type include methyl bis(3-aminopropyl)amine, methyl bis(2-aminoethyl)amine, N-(2-aminoethyl)piperazine, 4,7-dimethyltriethylenetetramine and the like.

The dicarboxylic acids which can be reacted with the foregoing polyamines to form the polyamide-polyamine precursors of the proposed cross-linking agents useful herein comprise the saturated aliphatic $C_3$–$C_{10}$ dicarboxylic acids. More preferred are those containing from 3 to carbon atoms, such as malonic, succinic, glutaric, adipic, and so on, together with diglycolic acid. Of these, diglycolic acid and the saturated aliphatic dicarboxylic acids having from 4 to 6 carbon atoms in the molecule, namely, succinic, glutaric and adipic are most preferred. Blends of two or more of these dicarboxylic acids may also be used, as well as blends of one or more of these with higher saturated aliphatic dicarboxylic acids such as azelaic and sebacic, as long as the resulting long chain polyamide-polyamine is water-soluble or at least water-dispersible.

The polyamide-polyamine materials prepared from the foregoing polyamines and dicarboxylic acids are reacted with epichlorohydrin to form the cationic cross-linking agents preferred for use in the scrubbing bead mixture herein. Preparation of such materials is described in greater detail in Keim, U.S. Pat. No. 2,926,116, Issued Feb. 23, 1960; Keim, U.S. Pat. No. 2,926,154, Issued Feb. 23, 1960; and Keim, U.S. Pat. No. 3,332,901, Issued Jul. 25, 1967. The disclosures of all three of these patents are incorporated herein by reference.

The polyamide-polyamine-epicholorohydrin cross-linking agents of the type preferred for use herein are commercially marketed by Hercules Inc. under the trade name Kymene®. Especially useful are Kymene® 557H and Kymene® 557LX which are the epicholorohydrin adducts of polyamide-polyamines which are the reaction products of diethylenetriamine and adipic acid. They are marketed in the form of aqueous suspensions of the polymeric material containing about 12.5% by weight of solids.

The amino-epichlorohydrin cross-linking agent will generally comprise from 1% to 10% by weight of the polymeric adhesive component of the bead mixtures herein. More preferably, these amino-epicholorohydrin cross-linking agents will comprise from 4% to 8% by weight of the polymeric adhesive in the scrubbing bead mixture.

4) Scrubbing Bead Mixture Preparation

The abrasive scrubbing beads, polymeric adhesive and amino-epichlorohydrin cross-linking agent, along with a suitable liquid, e.g., distilled water, and appropriate formulation adjuvants, such as agents for pH, viscosity, surface tension, foaming and bead suspension control, are admixed to form a stable liquid scrubbing bead mixture having rheological properties which render this liquid mixture printable onto the base nonwoven substrate. Scrubbing bead mixtures of this type are generally those having a pH within the range of from about 7 to 9, a viscosity of from about 70 to 2500 centipoise, and a surface tension value of from about 24 to 32 dynes/cm. More preferably, the liquid scrubbing bead mixture will have a pH which ranges from about 7.8 to 8.2, a viscosity of from about 400 to 800 centipoise, and a surface tension value of from about 26 to 30 dynes/cm. Within liquid scrubbing bead mixtures of these characteristics, the ionically charged scrubbing beads are generally maintained in suspension and do not significantly settle out of the scrubbing bead mixture before or during subsequent printing operations.

In preferred embodiments of the present invention wherein polymeric adhesives which cure to relatively high hardness values are used, the viscosity of the scrubbing bead mixture can be relatively low. This is because the relatively harder adhesives, e.g., those fashioned from blends of certain acrylic latexes, are believed to have a reduced tendency to infuse into the base substrate. Accordingly, with such harder adhesives, there is a reduced need to use high viscosity scrubbing-bead mixtures as a means for minimizing the undesirable infusion of the adhesive into the substrate. Thus when relatively harder adhesive materials are employed, scrubbing bead mixture viscosities can range from about 150 to 800 centipoise, more preferably from about 200 to 600 centipoise.

In a preferred method for preparing the scrubbing bead mixture, the polymeric adhesive, distilled water, the polymeric scrubbing beads themselves, a surfactant-based surface tension control additive and a defoaming agent are combined in that order under constant agitation. A pH control agent, such as a caustic solution (e.g., 5% or 10% NaOH) can then be added to bring the mixture to the desired pH value. At this point, the amino-epichlorohydrin cross-linking agent can then be added along with whatever viscosity control or bead suspending agent may be needed. Agitation of this mixture should then be continued until all the components are thoroughly admixed, and a scrubbing bead composition of the requisite stability and printability has been realized.

The surface tension control agent can comprise any conventional surfactant-based, preferably anionic surfactant-based, material which will alter the surface tension of the scrubbing bead mixture to within the desired range. Likewise, defoaming agents are conventional known materials which serve to minimize or eliminate the undesirable foaming or frothing of the scrubbing bead mixture which could interfere with bead suspension or printability of the mixture.

The viscosity control agents which can be employed in formulating the scrubbing bead mixture can comprise any conventional thickening agent which will alter the rheological properties of liquid, e.g. aqueous, compositions. Such materials include, for example, the carboxy vinyl polymer materials marketed by the B. F. Goodrich Chemical Co. under the tradename Carbopol® and the acrylic polymer materials marketed by Rohm & Haas under the tradename Acrysol®. If employed, the viscosity control agent component of the scrubbing bead mixture will frequently comprise from about 0.05% to 0.6% by weight, more preferably from about 0.1% to 0.3% by weight, of the total solids in the scrubbing bead mixture.

The scrubbing bead mixture can also optionally contain adjuvants which may help maintain the charged polymeric beads in suspension but which do not necessarily alter the viscosity of the scrubbing bead mixture. Examples of this type of adjuvant are the methyl vinyl ether/maleic anhydride copolymer materials marketed under the tradename Gantrez®. If employed, bead suspending aids of this type will frequently comprise from about 0.5% to 1.5% by weight of the total solids in the scrubbing bead mixture.

C) Substrate Printing, Drying and Curing

To form the abrasive wiping articles herein, the liquid scrubbing bead mixture as hereinbefore described is printed onto at least one surface of the base nonwoven substrate also as herein- before described, and the substrate is then dried and the scrubbing bead mixture is cured. Any conventional printing procedure can be employed in this operation. Such procedures include flexographic printing, gravure printing, screen printing and spray addition. By whatever printing method is employed, scrubbing bead mixture should be printed onto about 20% to 70%, more preferably from about 30% to 50%, of the surface area of the side of the base nonwoven substrate which is subjected to the printing operation.

Printing of the scrubbing bead mixture onto the nonwoven substrate should be carried out in a manner suitable for imparting and ultimately affixing to the base substrate an abrasively effective amount of the scrubbing bead mixture. Frequently, this will involve printing an amount of the scrubbing bead mixture that will provide from about 1.5 to 10 grams of scrubbing beads per square meter of substrate surface on a dry basis. More preferably the scrubbing bead mixture can be printed onto the base substrate to the extent that from about 2.5 to 8.0 $g/m^2$ of scrubbing beads are provided.

Flexographic printing is a preferred method of applying the scrubbing bead mixture to the base nonwoven substrate. Flexographic printing involves the use of a fountain roll to pick up scrubbing bead mixture from a fountain tray. Scrubbing bead mixture is then transferred from the fountain roll to a print plate cylinder by means of an intermediate anilox roll which is used to control the amount of scrubbing bead mixture transferred to the print plate cylinder. The base nonwoven substrate is brought into contact with the print plate cylinder by means of an impression cylinder, at which point the scrubbing bead mixture is actually transferred from the print plate cylinder to the nonwoven substrate.

A schematic diagram of a suitable flexographic printing setup is set forth in FIG. 1 of the drawings herein. This FIG. 1 is described in greater detail hereinafter in Example I. Flexographic printing processes of the type preferred for use in preparing the wiping articles of the present invention are described in greater detail in "Flexography, Principles and Practices," published in 1980 by the Flexographic Technical Association, Inc. and the Foundation of the Flexographic Technical Association, Inc. and in Weiss, "Rotogravure and Flexographic Printing Presses," published in 1985 by the Converting Technology Corporation. Both of these publications are incorporated herein by reference.

After the liquid scrubbing bead mixture has been printed onto the base nonwoven substrate, the printed substrate is subjected to conditions which serve to bring about removal of liquid material, e.g. water, from, i.e., to bring about the drying of, the printed substrate. The printed substrate will generally be dried to a consistency of at least about 90%, more preferably at least about 95%. Typically, the printed substrate can be dried to this extent by subjecting the printed substrate to temperature conditions ranging from about 100° C. to 350° C., more preferably from about 150° C. to 300° C., for a period of from about 2 to 30 seconds, more preferably from about 3 to 10 seconds.

After the printed substrate has been dried to the requisite extent, the substrate is then subjected to conditions of temperature and time which are suitable for curing the solid components of the scrubbing bead mixture which has been printed onto the paper substrate. Curing involves the formation of cross-linking bonds between and within the various chemically reactive components of the scrubbing bead mixture. Curing will generally involve subjecting the dried printed substrate to temperature conditions of from about 10° C. to 50° C., more preferably from about 15° C. to 20° C., for a period of from about 7 to 30 days, more preferably from about 21 to 28 days.

Curing is generally continued until the polymeric adhesive material of the scrubbing bead mixture exhibits the requisite hardness characteristics as set forth hereinbefore. One advantage of the use of an amino- epichlorohydrin cross-linking agent in the scrubbing bead mixtures herein is that this component appears to permit acceptable curing of the scrubbing bead mixture components at non-elevated temperatures, e.g., temperatures no greater than 30° C., and with acceptably short curing times, e.g., no longer than about 28 days.

Curing of the solid components of the printed scrubbing bead mixture also serves to increase the strength and integrity of the wiping article. Both burst and tensile strength of the nonwoven substrate can be enhanced by the curing process. One useful measure of the extent to which curing has occurred is to determine the increase in wet burst strength of the substrate over time. Wet burst can be determined experimentally by art-recognized L) testing methods such as those described in TAPPI Test #T-403-om-85. Curing of the dried printed substrate will frequently be continued until the wet burst strength of the articles herein is at least 300 grams, more preferably at least 400 grams, when tested in accordance with these TAPPI procedures.

D) Preferred Configurations of Printed, Cured Substrates

So long as the scrubbing bead mixture is printed onto the requisite percentage of the surface area of the base nonwoven substrate in the requisite amount, the particular pattern of the printed scrubbing bead mixture is not critical. Preferably, however, the nonwoven substrate will be printed in the manner that provides a discrete pattern of regularly repeating areas of covered surface and uncovered surface. Printing of the substrate in this manner serves to enhance the cleaning performance of the substrate while minimizing the inherent stiffening of the substrate and the inevitable absorbency decrease which comes with the application to the substrate of the scrubbing bead mixture.

In a particularly preferred embodiment of the present invention, the scrubbing bead mixture is printed onto the base nonwoven substrate in a regular pattern of discrete, substantially parallel lines. In typical paper towel products useful for household cleaning, the parallel lines will have an average width which, for example, ranges from about 0.25 to 1.52 mm (10 to 60 mils), more preferably from about 0.35 to 1.1 mm (14 to 43 mils). The average spacing between the parallel lines, i.e. the pitch, of the printed pattern of scrubbing bead mixture will preferably range from about 1.6 to 6.4 mm (1/16 to ¼ inch), more preferably from about 2.3 to 4.8 mm (3/32 to 3/16 inch).

Figure 2:
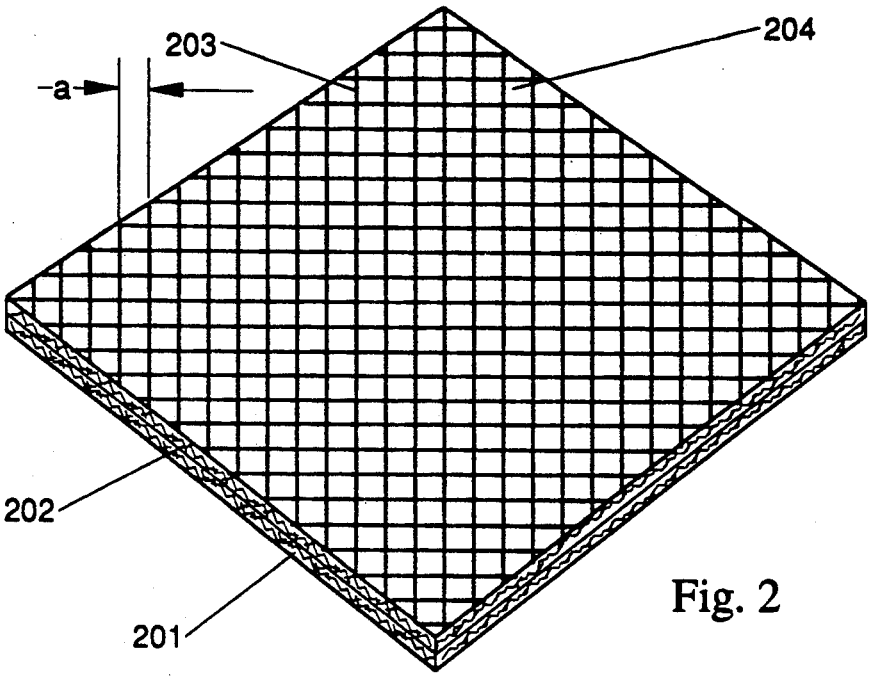
FIGS. 2 and 2*a* show a paper towel substrate having a preferred pattern of scrubbing bead mixture printed thereon.
Figure 2A:
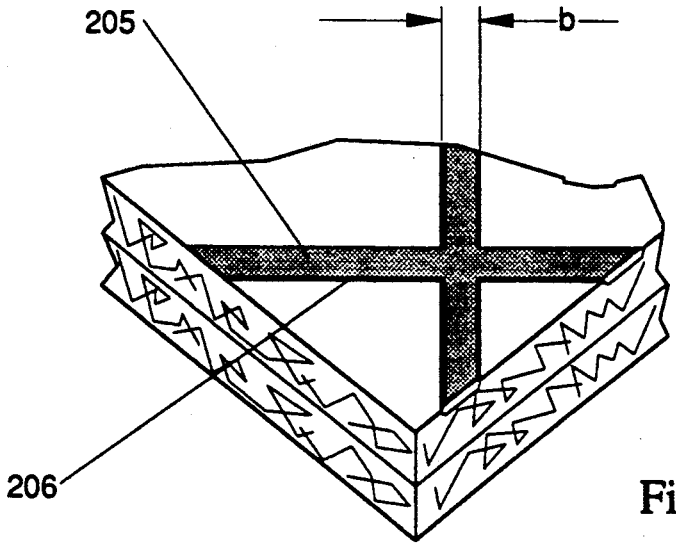

FIGS. 2 and 2*a* of the drawings depict a paper towel substrate having printed thereon a preferred pattern of scrubbing bead mixture. The base paper substrate is shown in FIG. 2 as a laminated product having two plies, 201 and 202. Printed onto the outer surface of one of the plies, 202, is a pattern, 203, of parallel and perpendicular lines of scrubbing bead mixture. Between the lines which form the pattern are open areas, 204, of the paper substrate surface, which open areas are available for liquid absorbing and soil pickup. The spacing or pitch, between the lines of printed scrubbing bead mixture is depicted in FIG. 2 as Dimension a.

FIG. 2*a* is a magnified closeup depiction of a small section of the printed surface of substrate ply 202. FIG. 2*a* shows that the lines of cured scrubbing bead mixture are formed of abrasive particles, 205, which are embedded in a cured polymeric adhesive latex material, 206. The width of the scrubbing bead mixture lines which form the pattern on the substrate surface is depicted in FIG. 2*a* as Dimension b.

In preferred configurations of the abrasive wiping articles herein, the weight ratio of the abrasive beads to the nonwoven substrate (dry basis) will generally range from about 1.5:100 to 2:3, more preferably from about 1:20 to 1:4. Furthermore in such preferred configurations, the weight ratio of abrasive beads to the solid adhesive-crosslinker material will generally range from about 3:7 to 7:3, more preferably from about 4:6 to 6:4.

Figure 3A:
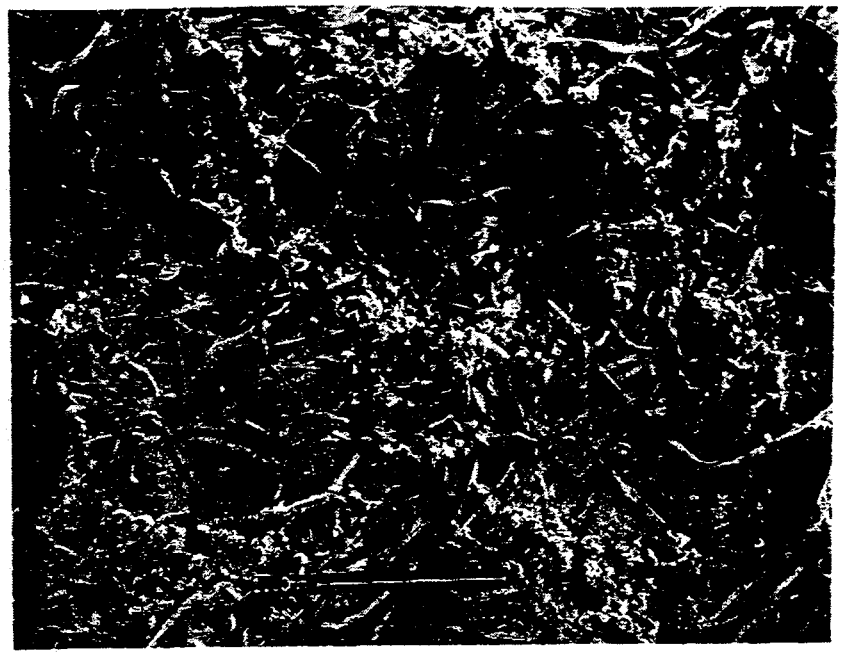
FIGS. 3*a*, 3*b* and 3*c* are photomicrographs showing lines of polymeric abrasive particles affixed by means of a polymeric adhesive to the base substrate of the articles herein.
Figure 3B:
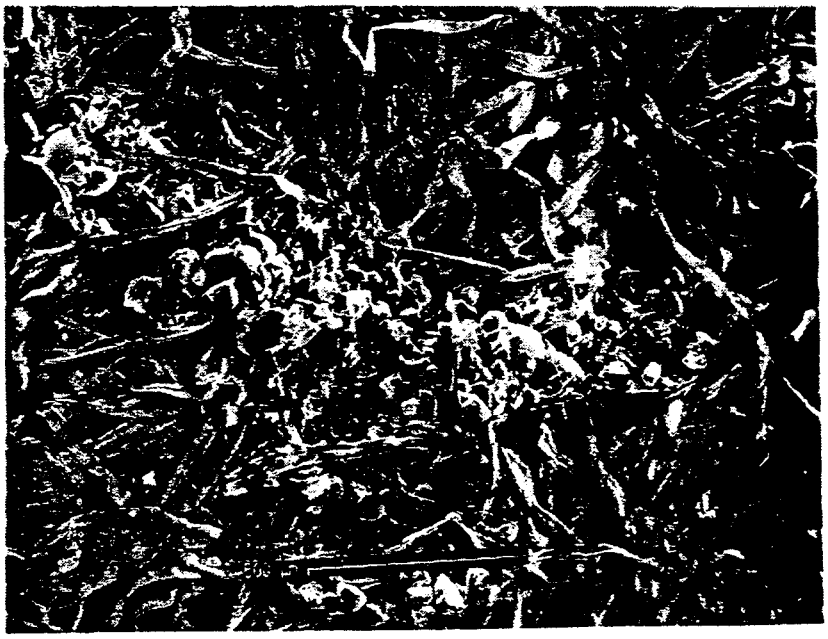
Figure 3C:
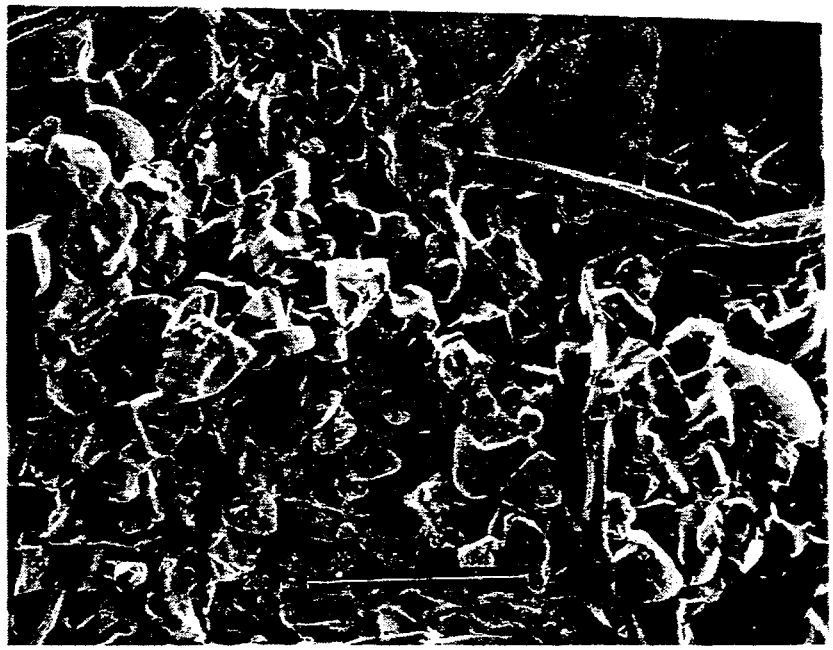

In a highly preferred wiping article configuration, the polymeric abrasive particles, preferably with angular cutting edges on their surfaces, can be affixed to the base nonwoven substrate in a manner such that exposed portions, preferably with cutting edges, of the abrasive particles protrude perpendicularly above the surface of the nonwoven substrate and also above the surface of the hardened adhesive material in which they are embedded. FIG. 3 is a photomicrograph of one section of a printed line of affixed scrubbing particles wherein the abrasive scrubbing particles are shown to protrude above and extend up from the surface of a base paper substrate to which they are affixed.

In highly preferred configurations, the average dimension of the exposed portion of the abrasive particles which extends perpendicularly above the substrate (including adhesive) surface will range from about 40 to 300 microns, more preferably from about 75 to 250 microns. Also the abrasive particles utilized in these particular preferred configurations are preferably both relatively large and relatively hard. Such particles, for example, will preferably range in size from about 100 to 300 microns and will preferably exhibit a Knoop hardness of from about 15 to 22.

The abrasive wiping articles of the present invention, as well as their preparation and use, are illustrated by the following examples:

EXAMPLE I

Sheets of two-ply paper toweling are prepared having printed thereon a pattern of a cured liquid dispersion of polymeric scrubbing beads. Each step of the procedure for preparing such towel sheets is described in detail as follows:

A) Base Substrate Preparation

A paper substrate is prepared from a papermaking furnish (60% Northern Softwood Kraft/40% chemo-thermo-mechanical pulp) on a pilot scale papermaking machine. The setup of the papermaking machine is described in greater detail in the Examples I of both U.S. Pat. No. 3,301,746 and U.S. Pat. No. 4,441,962. Such a setup involves the deposition of the papermaking furnish onto a Fourdrinier wire to form an embryonic web which is then transferred to an imprinting fabric that is used, after partial drying of the web, to impart a pattern of high density and low density zones into the paper web. The imprinting fabric has a five-shed weave of 24×20, MD×CD, filaments per centimeter. The patterned densified web is then transferred to a Yankee dryer drum for final drying.

Paper from this process is further converted to an embossed laminate having a knob-to-knob emboss pattern. Two plies of the resulting web are formed into paper towel product by laminating the plies together using polyvinyl alcohol as an adhesive. The technique used is that described in general in Wells; U.S. Pat. No. 3,414,459; Issued Dec. 3, 1968.

The two-ply laminated towel substrate material prepared in the foregoing manner has the following characteristics:

Basis Weight ($g/m^2$)—57
Wet Caliper (mm)—0.91 at 0.2 psi
Dry Caliper (mm)—1.22 at 0.2 psi B) Scrubbing Bead Mixture Preparation An aqueous dispersion of polymeric scrubbing beads is prepared by thoroughly mixing the following components as set forth in Table I.

TABLE 1

| Component | % Solids | Amt Used (gms) | % of Total | Solids (gms) | % of Solids |
|---|---|---|---|---|---|
| Rhoplex ® E-1847 Latex Adhesive | 44.00% | 180.00 | 22.08% | 79.20 | 26.92% |
| Rhoplex ® B-85 Latex Adhesive | 38.00% | 135.00 | 16.56% | 51.30 | 17.43% |
| Distilled Water | 0.00% | 30.00 | 3.68% | 0.00 | 0.00% |
| Elvacite ® 2008 Carboxylated Polymethyl Methacrylate Fractured Polymer Particles | 100.00% | 158.00 | 19.38% | 158.00 | 53.70% |
| Dawn ® Liquid Detergent | 0.00% | 9.00 | 1.10% | 0.00 | 0.00% |
| "Dow 65" Defoaming Agent | 0.00% | 9.00 | 1.10% | 0.00 | 0.00% |
| NaOH Solution (5%) | 5.00% | ~9.83 | 1.21% | 0.49 | 0.17% |
| Kymene ® 557-LX Crosslinking Agent | 12.50% | 32.00 | 3.93% | 4.00 | 1.36% |
| Pontamine ® 8GL Dye | 0.00% | 1.00 | 0.12% | 0.00 | 0.00% |
| Carbopol ® 940 Solution Thickener (1.25 g in 250 ml water) | 0.50% | 251.25 | 30.83% | 1.25 | 0.42% |
| | Totals | 815.08 | 100.00% | 294.24 | 100.00% |
| % Solids | | | 36.10% | | |

The Rhoplex ® E-1847 and Rhoplex ® B-85 latex adhesives are acrylic latex emulsions. Upon curing, Rhoplex E-1847 adhesive has a Knoop hardness of about 0.5. The Rhoplex ® B-85 adhesive, upon curing, has a Knoop hardness of about 20. Blends of these two latexes exhibit an intermediate hardness based on their relative proportion in the blend. Both types of these Rhoplex ® latexes are commercially marketed by Rohm & Haas. Based on the relative amounts of the two latexes used in Example I, this latex blend is estimated to have a Knoop hardness of about 0.8 after curing on the paper substrate.

The Elvacite ® polymethyl methacrylate polymer beads, prior to fracturing, are generally spherical with a median diameter of about 150 microns, a Knoop hardness of about 20, a specific gravity of 1.2 and are carboxylated to give an Acid Number of 9 (mg of neutralizing KOH per gram). These spherical beads are ground to fracture them into angular particles having minor dimensions which range from about 50 to 105 microns. The Elvacite ® beads are commercially marketed by Du Pont.

The Kymene ® 557-LX cationic crosslinker is an aqueous solution of a cationic polyamide-polyamine-epichlorohydrin adduct. It is prepared by reacting epichlorohydrin with a polyamide-polyamine derived from adipic acid and diethylenetriamine. Kymene ® 557-LX is commercially marketed by Hercules, Inc.

The Dawn ® Liquid Detergent, "Dow 65" defoamer and Carbopol ® viscosity control agent are all additionally used to modify and adjust the properties of the bead mixture preparation to optimize the printability of the mixture onto the paper substrate. Dawn ® is a commercially available, anionic/nonionic surfactant-containing dishwashing product marketed by The Procter & Gamble Company. "Dow 65" is a silicone emulsion commercially marketed by Dow Corning. Carbopol ® 940 is a carboxy vinyl polymer mixture commercially marketed by B. F. Goodrich Chemical Company.

The scrubbing bead mixture is prepared by combining the first six Table I components, in the order listed, with constant stirring. The sodium hydroxide solution is then slowly added with constant vigorous stirring until the pH of the mixture is 8.0 (±0.1). Vigorous stirring is continued for at least five minutes after the sodium hydroxide solution has been added. It is imperative that the mixture be stirred well during this step. Lack of sufficient stirring can cause problems with viscosity and therefore subsequently with printing. The Kymene ®, the dye (Mobay Chemical) and the Carbopol ® solution (in that order) are then added with constant stirring to form the scrubbing bead mixture suitable for use in the printing process. The resulting scrubbing bead mixture has a viscosity of about 700 cps. and a surface tension value of about 29 dynes/cm.

C) Flexographic Printing of Scrubbing Bead Mixture Onto Substrate

The scrubbing bead mixture as hereinbefore described is printed onto the two-ply paper substrate, one side at a time, by means of a flexographic printing process. Such a process is illustrated in FIG. 1 of the drawings herein.

In the flexographic printing process, the two-ply paper substrate, 100, is routed from an unwind stand through a series of guides and rollers, 101, to an impression cylinder, 102. The scrubbing bead mixture, 103, is held in a fountain tray, 104, and is transferred from the fountain tray, 104, by means of a fountain roll, 105, and an anilox roll, 106, to a print plate cylinder, 107. In the setup depicted in FIG. 1, the spacing (gap) between fountain roll, 105 and the anilox roll, 106, is controlled by the Fountain Roll Control Knob shown schematically in FIG. 1 as element 108. Both the spacing (gap) between the anilox roll, 106 and the print plate cylinder, 107, and the spacing (gap) between the print plate cylinder, 107, and the impression cylinder, 102, are controlled by the two Control Knobs shown schematically in FIG. 1 as elements 109 and 110.

Figure 4:
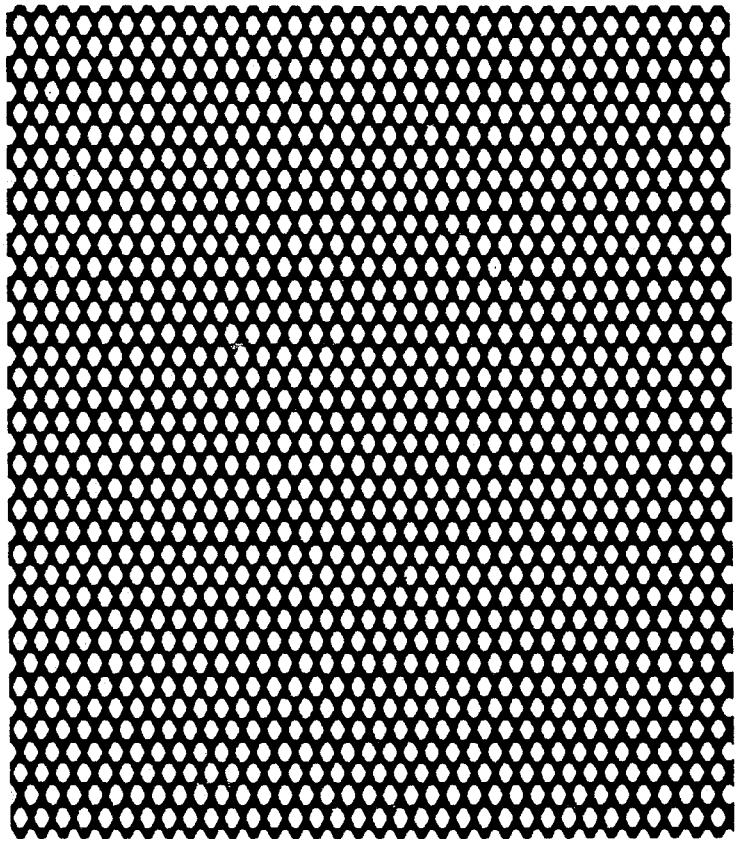
FIG. 4 shows a "linear Idaho" configuration of the print plate used in the flexographic printing process depicted in FIG. 1.

The configuration of the print plate on the print plate cylinder, 107, is of a "linear Idaho" pattern as shown in FIG. 4 of the drawings herein and has 23 cells/cm$^2$. This pattern serves to print a pattern which approximates parallel lines onto approximately 40% of the surface area of the paper substrate. Such lines have an average width of about 0.8 mm, and the lines are printed having an average pitch (i.e., the dimension between the flat sides of each "linear Idaho" cell) of about 3.2 mm.

The flexographic printing process as hereinbefore described is used to print approximately 8.8 g/m$^2$ of scrubbing beads onto each side of the two-ply paper substrate. After each side is printed, the substrate proceeds, by way of an assist wire, to a forced air drying cabinet wherein the substrate is dried to a moisture content of about 5% by weight, and the sheet is then rewound onto a roll. Curing proceeds at room temperature; maximum tensile strength is achieved in approximately 4 weeks.

Sheets of the resulting paper towel product are especially useful for removing a variety of soils from hard surfaces in the context of household cleaning applications.

EXAMPLE II

A paper towel product similar to that described in Example I is prepared using a different scrubbing bead mixture, a different print plate orientation and a different amount of scrubbing beads applied to the two-ply paper substrate.

The scrubbing bead mixture of Example II comprises the components set forth in Table II. The components set forth in Table II are essentially identical to those described hereinbefore in Table I. The scrubbing bead mixture is prepared in the same general manner as set forth hereinbefore in Example I. This Table II scrubbing bead mixture has a pH of about 8.0, a viscosity of about 515 cps. and a surface tension of about 29 dynes/cm.

The Table II scrubbing bead mixture is printed onto a two-ply base paper substrate essentially identical to the substrate which is described in Example I.

A flexographic printing and drying procedure essentially identical to that described hereinbefore in Example I is used to print approximately 7.3 g/m$^2$ of scrubbing beads onto each side of the two-ply paper substrate, but with the print plate oriented such that the long dimension of each "linear Idaho" cell is perpendicular to the machine direction (i.e. perpendicular to the circumferential direction of the print cylinder). Upon curing, the Rhoplex® E-1847 latex adhesive is estimated to exhibit a Knoop hardness of about 0.5.

TABLE II

| Component | Weight % |
|---|---|
| Rhoplex ® E-1847 Latex Adhesive (44% Solids) | 36.5 |
| Distilled Water | 5.5 |
| Elvacite ® 2008 Carboxylated Polymethyl Methacrylate Fractured Polymer Particles | 16.1 |
| Dawn ® Liquid Detergent | 1.1 |
| "Dow 65" Defoaming Agent | 1.1 |
| NaOH Solution (5%) | 2.6 |
| Kymene ® 557-LX Crosslinking Agent (12.5% Solids) | 6.4 |
| Pontamine ® 8GL Dye | 0.1 |
| Carbopol ® 940 Solution Thickener (1.75 g in 250 ml water) | 30.6 |
| | 100.0% |

TABLE II-continued

| Component | Weight % |
|---|---|
| | 100.0% |

EXAMPLES III-IV

Paper towel products similar to those described in Examples I and II are prepared using a different type of base paper substrate and using other types of scrubbing bead mixtures.

The base paper substrate onto which scrubbing bead mixtures are printed comprises a single ply paper web having a distinct continuous network region and a plurality of domes dispersed throughout the whole of this network region. Such a substrate is prepared by forming an embryonic paper web on a Fourdrinier wire in conventional fashion and by then associating this embryonic web with a foraminous deflection member having a patterned network surface formed by a plurality of discrete isolated deflection conduits. The papermaking fibers in the embryonic web are forced into the deflection conduits of the deflection member as water is removed from the web, and the web is then subsequently further dried and foreshortened. Such a process for forming this type of base paper substrate is described in greater detail in Trokhan; U.S. Pat. No. 4,637,859; Issued Jan. 20, 1987 and in Trokhan; U.S. Pat. No. 5,073,235; Issued Dec. 17, 1991.

To form the base substrate used in the following examples, a papermaking furnish comprising 60% Northern Softwood Kraft pulp and 40% chemo-thermo-mechanical pulp is processed on a pilot scale papermaking machine using the procedure generally described in the Example in the aforementioned '859 patent. The resulting substrate has a basis weight of about 33 g/m$^2$ and a dry caliper of about 0.7 mm. The pattern of the domes dispersed throughout the network region of the paper substrate corresponds to that of FIG. 2 of the aforementioned '235 patent in a configuration designated as a "linear Idaho" pattern.

Two types of scrubbing bead mixtures are prepared for printing onto base paper substrates of the type hereinbefore described. These scrubbing bead mixtures and the printed substrates prepared therefrom are described in greater detail as follows:

EXAMPLE III

The scrubbing bead mixture of Example III comprises the components set forth in Table III.

TABLE III

| Component | Weight % |
|---|---|
| Rhoplex ® TR-520 Latex Adhesive (50% solids) | 53.6 |
| Distilled Water | 17.7 |
| Tyrez ® #97851-00 Carboxylated Styrene-Butadiene Copolymer Beads | 13.4 |
| Dawn ® Liquid Detergent | 0.5 |
| "Dow 65" Defoaming Agent | 0.5 |
| NaOH Solution (10%) | 5.6 |
| Kymene ® 557H Crosslinking Agent (12.5% Solids) | 8.6 |
| Pontamine ® 8GL Dye | 0.1 |
| | 100.0% |

The Rhoplex ® TR-520 latex adhesive is a self-crosslinking acrylic latex emulsion. Upon curing, this adhesive has a Knoop hardness of about 0.5. The Rhoplex ® TR-520 latex emulsion is commercially marketed by Rohm & Haas.

The Tyrez ® beads are generally spherical particles of carboxylated styrene-butadiene copolymer having diameters ranging between 5 and 80 microns, a Knoop hardness of less than 10, a specific gravity of about 0.6 and an Acid Number of about 20 (mg of KOH per gram). These Tyrez beads are commercially marketed by Reichhold Chemicals Inc.

The other components set forth in Table III are essentially identical to those described hereinbefore in Table I. The scrubbing bead mixture itself is prepared in the same general manner as set forth hereinbefore in Example I. This Table III scrubbing bead mixture has a pH of about 8.0, a viscosity of about 255 cps. and a surface tension value of about 28 dynes/cm.

The Table III scrubbing bead mixture is printed onto the single-ply base paper substrate using a flexographic printing procedure essentially identical to that described hereinbefore in Example I. The configuration of the print plate used in this process is of a "linear Idaho" pattern similar to that of FIG. 4. The pattern has about 47 cells/cm$^2$. Such a print plate serves to print a pattern of lines on approximately 35% of the surface area of the single-ply substrate. Such lines have an average width of about 0.4 mm, and the lines are printed having an average pitch of about 2.3 mm.

The flexographically printed substrate contains about 2.8 g/m$^2$ of the scrubbing beads. After printing, the substrate is dried to a moisture content of about 5% by weight. The dried printed substrate is then emboss laminated into a two-ply paper towel product having a knob-to-knob pattern. Embossed lamination is carried out using a polyvinyl alcohol adhesive in the general manner described in Wells; U.S. Pat. No. 3,414,459; Issued Dec. 3, 1968.

EXAMPLE IV (Comparative)

The scrubbing bead mixture of comparative Example IV is similar to that used in Example III but contains no Kymene crosslinking agent of the type essentially employed in the scrubbing bead mixture of the present invention. The scrubbing bead mixture of comparative Example IV comprises the components set forth in Table IV.

TABLE IV

| Component | Weight % |
|---|---|
| Rhoplex ® TR-520 Latex Adhesive (50% solids) | 33.0 |
| Distilled Water | 32.9 |
| Tyrez ® #97851-00 Carboxylated Styrene-Butadiene Copolymer Beads | 33.0 |
| Dawn ® Liquid Detergent | 0.5 |
| "Dow 65" Defoaming Agent | 0.5 |
| Colored Dye (Green) | 0.1 |
| | 100.0% |

The components set forth in Table IV are essentially identical to those described hereinbefore in Table III. The scrubbing bead mixture itself is prepared in the same general manner as set forth hereinbefore in Example I. This Table IV scrubbing bead mixture has a pH of about 5.2 and a surface tension value of about 26 dynes/cm.

The Table IV scrubbing bead mixture is printed onto the single-ply base paper substrate using a flexographic printing procedure essentially identical to that described hereinbefore in Example I. The configuration of the print plate used in this process is of a "linear Idaho" pattern having 47 cells/cm$^2$. Such a print plate serves to print a pattern of lines on approximately 35% of the surface area of the single-ply substrate.

The flexographically printed substrate contains about 3.7 g/m$^2$ of the scrubbing beads. After printing, the substrate is dried to a moisture content of about 5% by weight. The dried printed substrate is then emboss laminated into a two-ply paper towel product having a knob-to-knob pattern. Embossed lamination is carried out using a polyvinyl alcohol adhesive in the general manner described in Wells; U.S. Pat. No. 3,414,459; Issued Dec. 3, 1968.

EXAMPLE V

The comparative hard surface cleaning performance of several types of paper towel products, including paper towels of the present invention, is tested by means of a Gardner Cleaning Test. Such a test involves the use of sheets of test towel products to remove soil which has been baked onto white fiberglass panels. Such a test is carried out in the following manner:

A) Preparation of Soiled Fiberglass Panels

White fiberglass panels (27.3 cm×7.0 cm; Owens-Corning #OC-SS48) are stained for cleaning tests. The stain is made by mixing four fluid ounces of lowfat (2%) milk, two large chicken eggs, and 100 mg lampblack and blending for 30 seconds at medium speed in an Osterizer blender. The stain is applied to the panels by use of an airbrush at 25 psig. The soiled panels are then heated at 160° C. for 1 hour in a forced-air oven.

B) Test Procedure for Paper Towel Sample Soil Removal

The paper towel sheets are tested for cleaning ability by attaching them to a Gardner Straight Line Washability and Abrasion Tester in such a way that a square (3.5 cm×3.5 cm) of the towel will be used for cleaning. A piece of silicone rubber (0.8 mm thick) is used as a backing material between the towel sample and the carrier of the Gardner machine. The towel sample is sprayed with 1.32 grams distilled water and a soiled fiberglass panel is placed under the towel sample on the Gardner machine. The machine is turned on and the towel sample is allowed to scrub the soiled panel (under 6 psi pressure from a constraining weight) for various numbers of strokes. The Gardner machine is then stopped, and the fiberglass panel is removed.

The scrubbed panel is measured (at several points) on a Technibrite Model TB-lC Brightness, Opacity, and Whiteness Meter. The Technibrite readings are then used to calculate a "Whiteness Index" value for each area measured on the scrubbed panel. These Whiteness Index values are examined statistically to determine whether one sample produces a whiter surface (better cleaning) than other samples. Results are reported as a value called "Percent of Total Achievable Whiteness" (%TAW) with 0% TAW representing no soil removed from the soiled panel and 100% TAW representing a completely clean panel.

C) Test Results

Three types of paper towel samples are tested in the manner hereinbefore described. These include two samples of the present invention and the unprinted Example II substrate which contains no abrasive. The two towel products of the present invention correspond to samples of the Example II and Example III products hereinbefore described.

Soil removal performance results for the several towel substrate types are set forth in Table V.

TABLE V

| No. of Strokes | Example II Avg % TAW | Example III Avg % TAW | Example III (Repeat) Avg % TAW | Unprinted Example II Substrate Avg % TAW |
|---|---|---|---|---|
| 0 | 0 | 0 | 0 | 0 |
| 2 | 29.9 | 16.6 | | |
| 3 | | | 18.7 | 3.6 |
| 5 | 46.4 | 22.7 | | |
| 6 | | | 26.3 | 5.7 |
| 10 | 48.6 | 31.0 | | |
| 15 | | | 28.9 | 9.2 |

The Table V data indicate that towel products of the present invention, i.e., those with either carboxylated polymethyl methacrylate or carboxylated styrene-butadiene scrubbing beads, provide hard surface soil removal performance which is significantly better than that provided by an unprinted paper substrate product containing no abrasive scrubbing beads.

EXAMPLE VI

In this example, the extent to which polymeric scrubbing beads can be removed by solvent contact from the paper towel substrate is determined. Such determination can be made both by microscopy (qualitative) and gravimetric (quantitative) methods. Each type of method is described as follows:

A) Microscopy Method (Qualitative)

A sample of the polymer bead-containing paper towel to be tested (1 inch square) is examined microscopically, and photomicrographs of a representative area are taken. After microscopic examination, the towel sample is placed into a Soxhlet extractor without an extraction thimble. Approximately 30 ml of a very strong test solvent (tetrahydrofuran; THF) is placed into a 50-ml round-bottom flask, and the sample is extracted under reflux for 24 hours. The towel sample is allowed to air dry and is then examined again microscopically in the same (or a quite similar) area.

B) Gravimetric Method (Quantitative)

A small sample of polymer bead-containing paper towel (1 inch square) is dried in a vacuum desiccator. This sample is then extracted in a Soxhlet extractor for 24 hours as hereinbefore described using either THF or isopropanol (IPA) as the solvent. After extraction, the sample is allowed to air dry and is then dried once again in a vacuum desiccator. The dry weights of each sample before and after extraction are used to calculate the weight loss of the sample during extraction. This weight loss is considered to be loss of beads from the sample.

C) Test Results

Paper towel samples substantially similar to those described in Example III and in comparative Example IV are tested for solvent removal of beads. The results for the THF solvent are illustrated in the series of photomicrographs set forth as FIGS. 5a, 5b, 5x and 5y of the drawings. The following Table VI illustrates the significance of each photomicrograph and also sets forth the results of gravimetric testing of test samples, both for a THF solvent and an IPA solvent.

TABLE VI

Figure 5A:
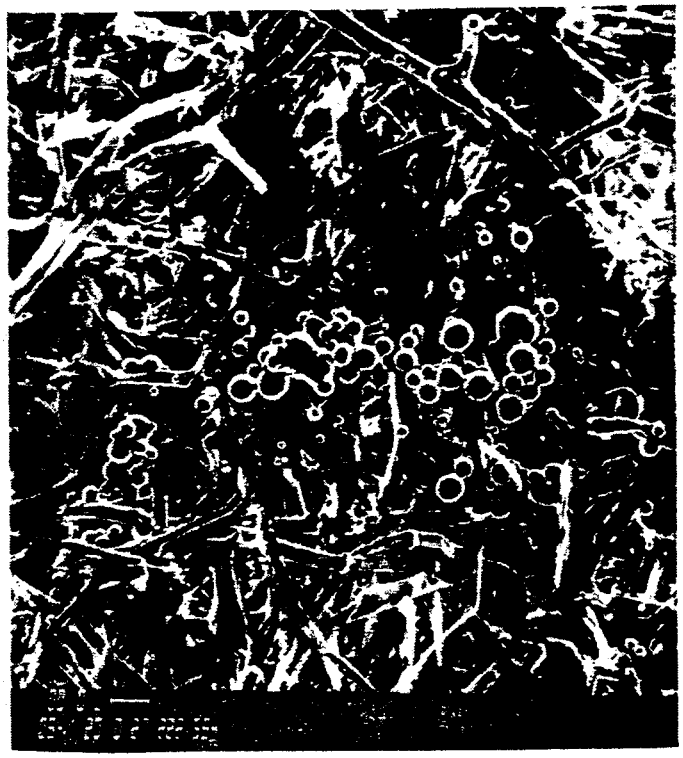
FIGS. 5*a*, 5*b*, 5*x* and 5*y* are photomicrographs showing the effects of solvent contact on abrasive particle-containing substrates both of this invention and of the prior art.
Figure 5B:
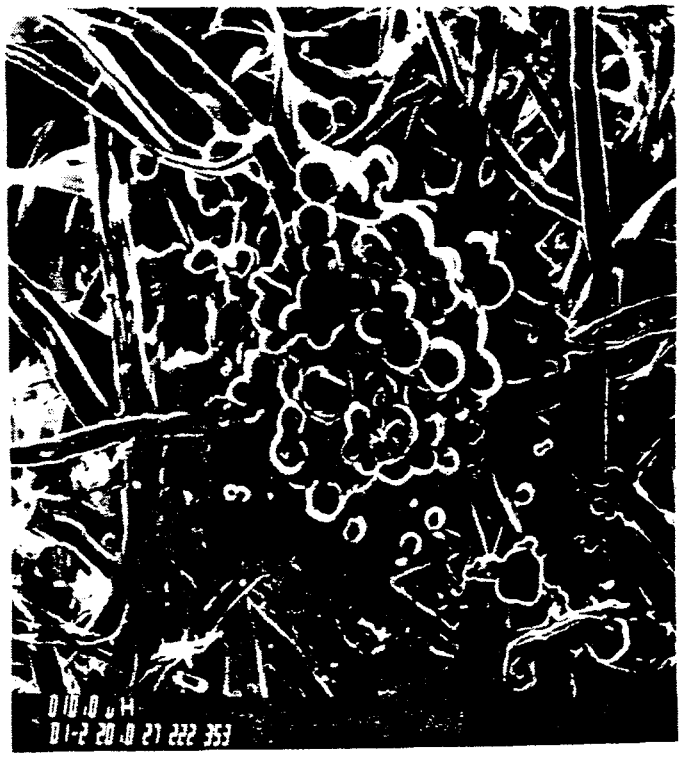
Figure 5X:
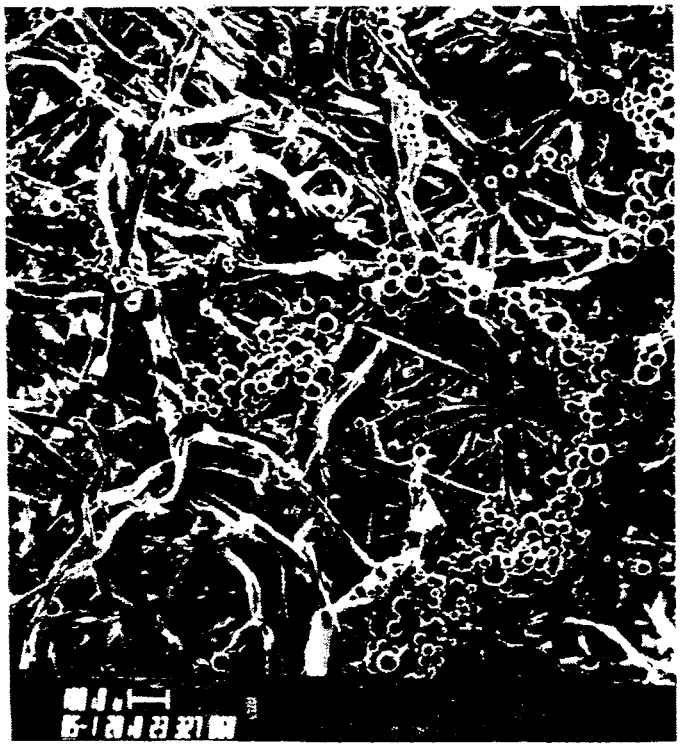
Figure 5Y:
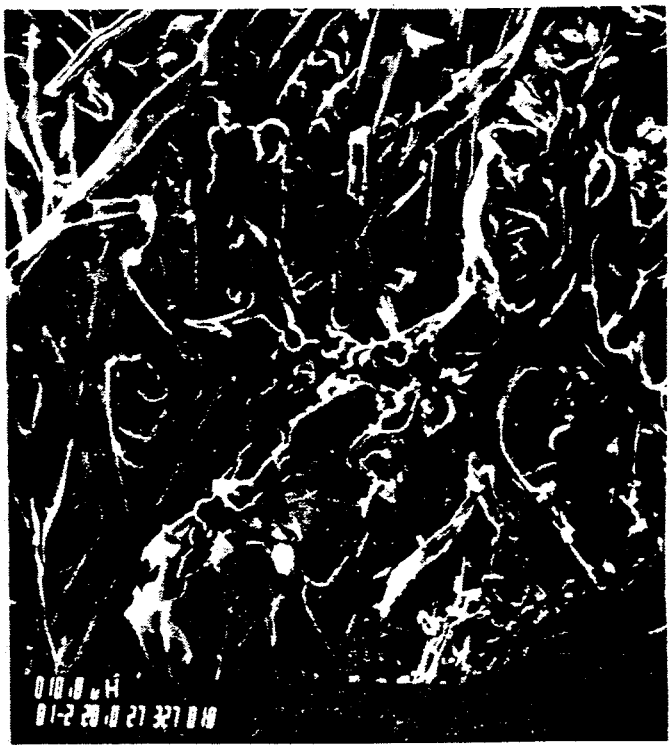

| Test Sample | Solvent Used THF | IPA |
|---|---|---|
| Example III - (Kymene) | | |
| Before Extraction | FIG. 5a | — |
| After Extraction | FIG. 5b | — |
| % Weight Loss | 3.5% | 0.05% |
| Example IV - (No Kymene) | | |
| Before Extraction | FIG. 5x | — |
| After Extraction | FIG. 5y | — |
| % Weight Loss | 25.2% | 2.6% |

Examination of the photomicrographs show that towel samples using a Kymene crosslinker had very few beads removed by extraction with the strong solvent THF. On the other hand, towel samples which used no Kymene crosslinker had a large percentage of their beads removed by tetrahydrofuran. Gravimetric analysis of the samples tested tends to confirm the results of the microscopic examination for the THF-extracted samples and also shows a similar trend with respect to bead extraction by the weaker solvent IPA.

EXAMPLE VII

This example illustrates the effect of the Kymene crosslinker in bringing about room temperature (20° C.) curing of the polymer bead scrubbing mixture printed onto the towel substrates of the present invention. The wet burst strength of towel samples is taken as an indication of the extent of bead mixture curing. Wet strength testing is carried out using a Thwing-Albert burst tester and the procedure of TAPPI #T-403-om-85.

Time dependent generation of wet strength is determined by measuring the wet burst strength of towel samples at various times after such samples have had scrubbing bead mixture flexographically printed thereon. The samples tested and their wet burst strength values are set forth in Table VII.

TABLE VII

| Sample Tested | Time After Printing (at room temperature) | Wet Burst |
|---|---|---|
| Unprinted Example III Substrate | — | 262 grams |
| Example III Substrate (Kymene) | 1 day | 376 grams |
| Example III Substrate (Kymene) | 4 days | 388 grams |
| Example III Substrate (Kymene) | 5 days | 421 grams |
| Example III Substrate (Kymene) | 26 days | 453 grams |
| Example IV Substrate (No Kymene) | 160 days | 230–280 grams |

The Table VII data indicate that the use of Kymene in the scrubbing bead mixture contributes significantly to the ability of the towel products herein to be cured at room temperature.

EXAMPLE VIII

A paper towel product similar to that described in Example I is prepared using a latex blend as the adhesive. Such an adhesive when cured is significantly harder than the latex blend used in Example I.

The paper towel product of this example is prepared using the scrubbing bead mixture described hereinafter in Table VIII.

TABLE VIII

| | % Solids | Amount Used (gms) | % of Total | Solids (gms) | % of Solids |
|---|---|---|---|---|---|
| Rhoplex ® E-1847 Latex Adhesive | 44.0% | 58.00 | 8.15% | 25.52 | 9.62% |
| Rhoplex ® B-85 Latex Adhesive | 38.0% | 271.00 | 38.08% | 102.98 | 38.82% |
| Distilled Water | 0.0% | 166.67 | 23.42% | 0.00 | 0.00% |
| Elvacite ® 2008 Carboxylated Polymethyl Methacrylate Fractured Polymer Particles | 100.0% | 129.00 | 18.13% | 129.00 | 48.63% |
| Dawn ® Liquid Detergent | 0.0% | 9.00 | 1.26% | 0.00 | 0.00% |
| "Dow 65" Defoaming Agent | 0.0% | 9.00 | 1.26% | 0.00 | 0.00% |
| Kymene ® 557-LX Crosslinking Agent | 12.5% | 42.00 | 5.90% | 5.25 | 1.98% |
| Pontamine ® 8GL Dye | 0.0% | 2.00 | 0.28% | 0.00 | 0.00% |
| Gantrez ® AN149 Solution (10 g in 90 ml water, then neutralized to pH 8) | 10.0% | 25.00 | 3.51% | 2.50 | 0.94% |
| | Totals | 711.67 | 100.00% | 265.25 | 100.00% |
| Total % Solids | | | 37.27% | | |

The Table VIII components are essentially identical to those described hereinbefore in Table I, with the substitution of an aqueous solution of Gantrez ® AN149 in place of the Carbopol ® 940 solution. Gantrez ® AN149 is a methyl vinyl ether/maleic anhydride copolymer and is commercially marketed by GAF Chemicals Corporation.

The Table VIII scrubbing bead mixture is prepared in a manner similar to that set forth hereinbefore in Example I, except that no sodium hydroxide solution is added, and 66.67 grams of the water are added at the end of the mixing procedure. The resulting Table VIII scrubbing bead mixture has a pH of about 8.2, an initial viscosity of about 300 centipoise, and a surface tension of about 29 dynes/cm.

The base paper substrate used for the towel product of this example is a two-ply substrate which is substantially identical to the substrate described in Example I. This Example VIII substrate does, however, have a slightly higher mechanical tensile strength. This is due to additional mechanical refining of the paper furnish prior to deposition onto the fourdrinier wire, during the papermaking operation.

A flexographic printing and drying procedure essentially identical to that described hereinbefore in Example I, with a print plate pattern as hereinafter described, is used to print the Table VIII scrubbing bead mixture onto each side of the two-ply paper substrate. The scrubbing bead mixture is printed to the extent sufficient to provide approximately 6.5 g/m$^2$ of scrubbing beads on each side.

The print plate pattern used in this example consists of two orthogonal sets of parallel lines, each set of which is oriented at 45° to the machine direction of the paper substrate. The combination of these sets of lines forms a grid pattern composed of cells of diagonally oriented squares. The lines are uniformly spaced at about 0.318 cm apart, with a uniform line width of about 0.711 mm. Such a print plate has about 9.92 cells/cm$^2$ and serves to print a pattern of lines on approximately 40% of the surface area of the paper substrate.

After the printed paper substrate has been dried and the latex adhesive cured, the Knoop hardness of the cured blend of Rhoplex ® E-1847 and Rhoplex ® B-85 latexes is estimated to be about 10.5. Such an estimate is based on Knoop microhardness measurements made on film samples of dried and cured blends of these two types of Rhoplex ® latexes used in the same ratio of E-1847 to B-85 as is employed in the Table VIII scrubbing bead mixture.

EXAMPLE IX

A test procedure similar to that hereinbefore described in Example V is used to compare the hard surface cleaning performance of samples of the paper towel products described in both Examples II and VIII. The tests are done on three different soil/surface combinations, using Cinch ® in place of distilled water as the added fluid. Cinch ® is a general purpose household cleaning product commercially marketed in a spray bottle dispensing format by The Procter & Gamble Company. The Egg/Milk soil and Textured Fiberglass surface used in this test are the same as hereinbefore described in Example V except that the stain is baked for 30 minutes instead of 1 hour. The Porcelain Ceramic tile surface is a glossy white tile 7.6 cm×27.9 cm, commercially available from Cherokee Porcelain Enamel Co., Knoxville, Tenn.

The Greasy Soap Scum stain is made by first mixing 79.9 gms of isopropanol and 10 gms of calcium stearate, and blending this mixture in an Osterizer blender at moderate speed for about 15 seconds. Ten grams of artifical body soil (commercially available from Empirical Manufacturing Co.) are then added, and this mixture is blended at high speed for about 15 seconds. Finally, 0.1 gm of carbon lampblack is added, and the mixture is blended at high speed for 60 seconds. The stain is applied to the surface by use of an airbrush. The soiled surfaces are then baked at 180° C. in a forced-air oven for 10 to 11 minutes in the case of the fiberglass panel, and for 25 minutes in the case of the porcelain ceramic tile.

A Straight Line Washability and Abrasion Tester substantially similar to that described in Example V, is configured in such a way that a rectangle (7.6 cm×12.7 cm) of the towel is used for cleaning. A constraining pressure of about 0.55 psi is used. The results are evaluated as hereinbefore described in Example V, and the approximate soil removal results are set forth hereinafter in Table IX.

TABLE IX

| | Average % TAW | | | | | |
|---|---|---|---|---|---|---|
| | Greasy Soap Scum on Textured Fiberglass Shower Stall Panel | | Greasy Soap Scum on Porcelain Ceramic Tile | | Egg/Milk on Porcelain Ceramic Tile | |
| No. of Strokes | Ex. II | Ex. VIII | Ex. II | Ex. VIII | Ex. II | Ex. VIII |

TABLE IX-continued

| | | | | | | |
|---|---|---|---|---|---|---|
| 4 | 31 | 24 | 75 | 92 | 50 | 89 |
| 7 | 38 | 30 | 100 | 100 | 81 | 100 |
| 16 | 44 | 31 | 100 | 100 | 100 | 100 |

The Table IX data indicate that towel products of the Example VIII type with its latex adhesive of relatively high hardness provide better overall cleaning for two of the three soil/surface combinations explored in comparison with Example II type towel products which employ a relatively softer latex adhesive.

EXAMPLE X

Two types of tests are used to compare the water absorbency performance of samples of the paper towel products as described in Examples II and VIII. The tests are the Horizontal Full Sheet Test (or HFS test) and the Horizontal Gravimetric Wicking Test (or HGW test).

The HFS test is a measure of the water holding capacity, after saturation and gravity drainage, of a 28 cm×28 cm sheet of paper towel. This test is substantially identical to the Horizontal Absorptive Capacity test as set forth in Trokhan, U.S. Pat. No. 4,469,735, Issued Sep. 4, 1984, incorporated herein by reference.

The HGW test is a point source demand wettability test that gives a measure of the rate of water absorbency of a circular sample of a dry towel. The procedures of and equipment used in a typical HGW test are described in greater detail in Chatterjee, *Absorbency, Textile Source and Technology, Vol.* 7. 1985 at pp. 60–68, and in Painter, *TAPPI* 68:12. Dec. 1985 at pp. 54–59. Both of these publications are incorporated herein by reference.

The HFS and HGW testing results for the towel products of Examples II and VIII are set forth in Table X.

TABLE X

| | Example II | Example VII |
|---|---|---|
| HFS | | |
| gm water/sheet | 57.7 | 70.0 |
| gm water/gm sample | 8.4 | 11.2 |
| HGW | | |
| gm water/min/gm sample | 10.6 | 28.6 |

The Table X data indicate that the Example VIII towel product with its relatively hard blend of adhesive latexes provides better absorbency of aqueous fluid than does a similar towel product of the Example II type which uses a softer latex adhesive.

It is, of course, possible to utilize the polymeric adhesive and amino-epichlorohydrin cross-linking agent components of the scrubbing bead mixture herein, without the polymeric abrasive particles, to form a liquid binder mixture that can be printed onto absorbent nonwoven substrates of the type utilized herein. In this manner, wiping articles having less abrasivity but desirably enhanced tensile and burst strength can be provided.

Such wiping articles can be prepared using the same general procedures hereinbefore described. Nonwoven substrates, such as absorbent paper, having a printed pattern which imparts from about 3 to 15 grams of polymeric adhesive per square meter of substrate surface and which covers from about 20% to 60% of the printed substrate surface area, provide wiping articles of high strength and integrity that can be cured at room temperature.

The liquid binder mixtures used to form such relatively abrasive-free wiping articles should have the same rheological characteristics as the abrasive-containing scrubbing bead mixtures hereinbefore described. Frequently in the abrasive-free liquid binder mixture, the polymeric adhesive will comprise from about 50% to 99% of the total solids therein. The amino-epichlorohydrin cross-linking agent will, as in the scrubbing bead mixtures, generally comprise from about 1% to 10% by weight of the polymeric adhesive.

An illustration of an abrasive particle-free, liquid binder mixture which can be printed onto absorbent nonwoven substrates is set forth in Example XI.

EXAMPLE XI

A liquid binder mixture is prepared having the components set forth in Table IX.

TABLE XI

| Component | Amount (g) |
|---|---|
| Rhoplex ® TR-520 Latex Adhesive (50% solids) | 100 |
| Distilled Water | 100 |
| Dawn ® Liquid Detergent | 2.5 |
| "Dow 65" Defoaming Agent | 1.25 |
| NaOH Solution (10%) | Amount to adjust pH to 8.1 |
| Kymene ® 557H Crosslinking Agent (12.5% Solids) | 16 |
| Pontamine ® 8GL Dye | 0.46 |

The components set forth in Table XI are essentially identical to those described hereinbefore in Table III. This liquid binder mixture is prepared in the same general manner as set forth hereinbefore in Example I for the scrubbing bead mixture. This Table XI binder mixture has a pH of about 8.1, a viscosity of about 100 cps. and a surface tension value of about 28 dynes/cm.

The Table XI binder mixture is printed onto an Example I type single-ply base paper substrate using a flexographic printing procedure essentially identical to that described hereinbefore in Example I. The flexographically printed substrate contains about 4 g/m$^2$ of the polymeric adhesive. After printing, the substrate is dried to a moisture content of about 5% by weight, and the printed binder mixture is cured at 20° C. for 30 days. Such a print-bonded substrate serves as a wiping article of enhanced wet strength with the cured printed adhesive having only minimal adverse impact on substrate softness and absorbency.

What is claimed is:

1. An abrasive wiping article for cleaning hard surfaces, said article comprising an absorbent nonwoven substrate having a dry basis weight of from about 30 to 100 g/m$^2$, onto at least one surface of which substrate is printed a pattern of an abrasively effective amount of a cured liquid scrubbing bead mixture which, prior to curing, has a viscosity of from about 70 to 2500 centipoise and a surface tension value of from about 24 to 32 dynes/cm and which comprises A) from about 30% to 70% by weight of total solids of carboxylated, ionically charged, polymeric abrasive particles ranging in particle size from about 20 to 400 microns and having a Knoop hardness of from about 4 to 25;

B) from about 30% to 70% by weight of total solids of a carboxyl group-containing polymeric adhesive material having, upon curing, a Knoop hardness of from about 0.5 to 17; and C) from about 1% to 10% by weight of the polymeric adhesive of an amino-epichlorohydrin cross-linking agent comprising the reaction product of epichlorohydrin and an amine reactant which is selected from i) monomeric mono -, di - and triamines; and ii) polyamide-polyamines derived from polyalkylene polyamines and $C_3$–$C_{10}$ dibasic carboxylic acids.

2. An article according to claim 1 wherein

A) the liquid scrubbing bead mixture, prior to curing, has a viscosity of from about 150 to 800 centipoise and a surface tension value of from about 26 to 30 dynes/cm.;

B) the polymeric abrasive particles comprise from about 40% to 60% by weight of the total solids in the scrubbing bead mixture, range in particle size from about 100 to 300 microns and range in Knoop hardness from about 15 to 22;

C) the polymeric adhesive material comprises from about 40% to 60% by weight of the total solids in the scrubbing bead mixture and has, upon curing, a Knoop hardness of from about 0.5 to 12; and D) the amino-epichlorohydrin cross-linking agent comprises from about 4% to 8% by weight of the polymeric adhesive.

3. An article according to claim 1 wherein the scrubbing bead mixture is printed onto a paper substrate in an amount which provides from about 1.5 to 10 grams of abrasive particles per square meter of substrate surface.

4. An article according to claim 3 wherein

A) the polymeric abrasive particles comprise carboxylated polymethyl methacrylate or carboxylated styrene-butadiene and have an Acid Number of from about 3 to 50;

B) the polymeric adhesive is an acrylic emulsion latex or blend of such latexes having, upon curing, a Knoop hardness of from about 8 to 15;

C) the amine reactant used to prepare the amino-epichlorohydrin cross-linking agent comprises a polyamide-polyamine derived from a polyethylene polyamine having from 2 to 4 ethylene groups and from a $C_4$–$C_6$ saturated aliphatic dicarboxylic acid; and D) the scrubbing bead mixture has a viscosity of from about 200 to 600 centipoise.

5. An article according to claim 4 wherein the amino-epichlorohydrin cross-linking agent is prepared from a polyamide-polyamine derived from diethylenetriamine and adipic acid.

6. An abrasive wiping article for cleaning hard surfaces, said article comprising an absorbent nonwoven substrate having a dry basis weight of from about 30 to 100 g/m$^2$, said substrate having affixed thereto an abrasively effective amount of polymeric abrasive particles which range in particle size from about 100 to 300 microns and which have a Knoop hardness ranging from about 4 to 25; a substantial portion of said particles having a plurality of angular cutting edges on the surfaces thereof; said particles further being affixed to said nonwoven substrate in a manner such that the average dimension of the exposed portion of said abrasive particles which extends perpendicularly from the substrate surface ranges from about 40 to 300 microns.

7. An article according to claim 6 wherein the nonwoven substrate is paper and the weight ratio of the abrasive particles to the paper substrate ranges from about 1.5:100 to 2:3.

8. An article according to claim 7 wherein the abrasive particles are affixed to the paper substrate by means of an adhesive-crosslinker combination which comprises A) a carboxyl group-containing polymeric adhesive material. having, upon curing, a Knoop hardness of from about 8 to 15; and B) an amino-epichlorohydrin cross-linking agent comprising the reaction product of epichlorohydrin and an amine reactant which is a polyamide-polyamine derived from a polyalkylene polyamine and a $C_3$–$C_{10}$ dibasic carboxylic acid.

9. An article according to claim 8 wherein the abrasive particles are affixed to one side of said substrate and cover from about 20 to 70% of the surface area of that one side.

10. An article according to claim 9 wherein the average dimension of the exposed portion of the abrasive particles which extends perpendicularly from the substrate surface ranges from about 75 to 250 microns.

11. An article according to claim 10 wherein the abrasive particles comprise carboxylated polymethyl methacrylate having an Acid Number of from about 8 to 37 and range in Knoop hardness from 15 to 22.

12. An article according to claim 11 wherein the cross-linking agent comprises from about 4% to 8% by weight of the polymeric adhesive in the adhesive-cross-linker combination used to affix the abrasive particles to the paper substrate.

13. A process for preparing an abrasive wiping article for cleaning hard surfaces, which process comprises A) printing onto at least one surface of an absorbent nonwoven substrate having a dry basis weight of from about 30 to 100g/m$^2$, an abrasively effective amount of a liquid scrubbing bead mixture which has a viscosity of from about 70 to 2500 centipoise and a surface tension value of from about 24 to 32 dynes/cm, and which comprises i) from about 30% to 70% by weight of total solids of carboxylated, ionically charged, polymeric abrasive particles ranging in particle size from about 20 to 400 microns and having a Knoop hardness of from about 4 to 25;

ii) from about 30% to 70% by weight of total solids of a carboxyl group-containing polymeric adhesive material having, upon curing, a Knoop hardness of from about 0.5 to 17; and iii) from about 1% to 10% by weight of the polymeric adhesive of an amino-epichlorohydrin cross-linking agent comprising the reaction product of epichlorohydrin and an amine reactant which is selected from a) monomeric mono -, di - and triamines; and b) polyamide-polyamines derived from polyalkylene polyamines and $C_3$–$C_{10}$ dibasic carboxylic acids;

B) drying said printed substrate to a consistency of at least about 90%; and

C) maintaining said printed substrate under curing conditions of time and temperature which are sufficient to promote formation of cross-linking covalent bonds between an within the chemically reactive components of the scrubbing bead mixture.

14. A process according to claim 13 wherein

A) the polymer abrasive particles comprise from about 40% to 60% by weight of the total solids in the scrubbing bead mixture, range in particle size from about 100 to 300 microns and range in Knoop hardness from about 15 to 22

B) the polymeric adhesive material comprises from about 40 to 60% by weight of the total solids in the scrubbing bead mixture and has, upon curing, a Knoop hardness of from about 0.5 to 12; and C) the amino-epichlorohydirn cross-linking agent comprises of from about 4% to 8% by weight of the polymeric adhesive.

15. A process according to claim 13 wherein scrubbing bead mixture is printed onto a paper substrate in an amount which provides from about 1.5 to 10 grams of abrasive particles per square meter of substrate surface.

16. A process according to claim 15 wherein the scrubbing bead mixture has a viscosity ranging from about 200 to 600 centipoise and a surface tension value ranging from about 26 to 30 dynes/cm and wherein the polymeric adhesive has, upon curing, a Knoop hardness of from about 8 to 15.

17. A process according to claim 16 wherein the dried printed substrate is cured for a period of from about 7 to 30 days at a temperature of from about 15° C. to 30° C.

18. A process according to claim 15 wherein the polymeric adhesive is an acrylic emulsion latex or blend of such latexes and the amino-epichlorohydirm cross-linking agent is formed from a polyamide-polyamine derived from diethylenetriamine and adipic acid.

19. A process according to claim 18 wherein the polymeric abrasive particles are comprised of a material selected from carboxylated polymethyl methacrylate and carboxylated styrene-butadiene and have an Acid Number of from about 3 to 50.

20. A process according to claim 19 wherein the scrubbing bead mixture is printed onto one side of the paper substrate and covers from about 20% to 70% of the surface area of that one side.

21. A wiping article suitable for household cleaning applications, said article comprising an absorbent nonwoven substrate having a dry basis weight of from about 30 to 100 g/m$^2$, onto at least one surface of which substrate is printed a pattern of a tensile and burst strength enhancing amount of a cured liquid binder mixture which, prior to curing, has a viscosity of from about 70 to 2500 centipoise and a surface tension value of from about 24 to 32 dynes/cm and which comprises A) a carboxyl group-containing polymeric adhesive material having, upon curing, a Knoop hardness of from about 0.5 to 17; and B) from about 1% to 10% by weight of the polymeric adhesive of an amino-epichlorohydrin cross-linking agent comprising the reaction product of epichlorohydrin and an amine reactant which is selected from i) monomeric mono -, di - and triamines; and ii) polyamide-polyamines derived from polyalkylene polyamines and $C_3$–$C_{10}$ dibasic carboxylic acids.

22. An article according to claim 21 wherein the binder mixture is printed onto a paper substrate and wherein in the binder mixture A) the carboxyl group-containing polymeric adhesive material has, upon curing, a Knoop hardness of from about 0.5 to 12; and B) the amino-epichlorohydrin cross-linking agent comprises the reaction product of epichlorohydrin and an amine reactant which is a polyamide-polyamine derived from a polyalkylene polyamine and a $C_3$–$C_{10}$ dibasic carboxylic acid.

23. An article according to claim 21 wherein in the binder mixture

A) the amine reactant used to prepare the amino-epichlorohydrin cross-linking agent comprises a polyamide-polyamine derived from a polyethylene poly-amine having from 2 to 4 ethylene groups and from a $C_4$–$C_6$ saturated aliphatic dicarboxylic acid; and B) the polymeric adhesive is an acrylic emulsion latex or blend of such latexes having, upon curing, a Knoop hardness of from about 8 to 15.

24. A process for preparing a wiping article suitable for household cleaning applications, which process comprises A) printing onto at least one surface of an absorbent nonwoven substrate having a dry basis weight of from about 30 to 100g/m$^2$, a tensile and burst strength enhancing amount of a liquid binder mixture which has a viscosity of from about 70 to 2500 centipoise and a surface tension value of from about 24 to 32 dynes/cm, and which comprises i) a carboxyl group-containing polymeric adhesive material having, upon curing, a Knoop hardness of from about 0.5 to 17; and ii) from about 1% to 10% by weight of the polymeric adhesive of an amino-epichlorohydrin cross-linking agent comprising the reaction product of epichlorohydrin and an amine reactant which is selected from a) monomeric mono -, di - and triamines; and b) polyamide-polyamines derived from polyalkylene polyamines and $C_3$–$C_{10}$ dibasic carboxylic acids;

B) drying said printed substrate to a consistency of at least about 90%; and

C) maintaining said printed substrate under curing conditions of time and temperature which are sufficient to promote formation of cross-linking covalent bonds between and within the chemically reactive components of the binder.

25. A process according to claim 24 wherein binder mixture is printed onto a paper substrate in an amount which provides from about 3 to 15 grams of polymeric adhesive per square meter of substrate surface.

26. A process according to claim 24 wherein the dried printed paper substrate is cured for a period of from about 7 to 30 days at a temperature of from about 15° C. to 30° C.

27. A process according to claim 26 wherein the polymeric adhesive is an acrylic emulsion latex or blend of such latexes having, upon curing, a Knoop hardness of from about 8 to 15, and wherein the amino-epichlorohydrin cross-linking agent is formed from a polyamide-polyamine derived from diethylenetriamine and adipic acid.

* * * * *